US011408174B2

(12) United States Patent
Tadros et al.

(10) Patent No.: US 11,408,174 B2
(45) Date of Patent: Aug. 9, 2022

(54) CONCRETE VOIDED FLOOR PANEL

(71) Applicants: e.Construct.USA, LLC, Omaha, NE (US); Tindall Corporation, Spartanburg, SC (US)

(72) Inventors: Maher K. Tadros, Omaha, NE (US); David Michael Gee, Omaha, NE (US); Kevin Kirkley, Woodstock, GA (US); Bryant Zavitz, Atlanta, GA (US)

(73) Assignees: E.CONSTRUCT.USA, LLC, Omaha, NE (US); TINDALL CORPORATION, Spartanburg, SC (US)

( * ) Notice: Subject to any disclaimer, the term of this patent is extended or adjusted under 35 U.S.C. 154(b) by 0 days.

(21) Appl. No.: 17/469,097

(22) Filed: Sep. 8, 2021

(65) Prior Publication Data

US 2022/0074206 A1 Mar. 10, 2022

Related U.S. Application Data

(60) Provisional application No. 63/075,624, filed on Sep. 8, 2020.

(51) Int. Cl.
*E04C 2/04* (2006.01)
*E04C 2/52* (2006.01)
(Continued)

(52) U.S. Cl.
CPC ..... *E04C 2/044* (2013.01); *E04B 5/043* (2013.01); *E04B 5/48* (2013.01); *E04C 2/06* (2013.01);
(Continued)

(58) Field of Classification Search
CPC ..... E04B 5/043; E04B 5/48; E04B 2103/02; E04C 2/50; E04C 2/044; E04C 2/06; E04C 2/34; E04C 2/521; E04C 2002/3483
See application file for complete search history.

(56) References Cited

U.S. PATENT DOCUMENTS 1,747,295 A * 2/1930 Goldsmith ..... E04B 5/40 52/392
1,767,066 A * 6/1930 Goldsmith ..... E04B 5/18 52/378
(Continued)

FOREIGN PATENT DOCUMENTS

CN 106836629 A * 6/2017
CN 207032648 U * 2/2018
(Continued)

*Primary Examiner* — Jessie T Fonseca
(74) *Attorney, Agent, or Firm* — Suiter Swantz pc llo

(57) ABSTRACT

A voided floor panel is provided. The voided floor panel includes a pre-cast dome, strands, reinforcing bars, and a slab. The pre-cast dome includes a flange portion, stem portions, and joint portions. The strands are pre-tensioned. The reinforcing bars are inserted through rebar block-outs of the pre-cast dome. The joint portions, the strands, and the reinforcing bars are cast within the slab. The strands improve a resistance of the slab to flexure. The joint portions improve a vertical shear resistance between the slab and the pre-cast dome. The joint portions may include corrugated dovetails for further improving a horizontal shear resistance between the slab and the pre-cast dome.

20 Claims, 22 Drawing Sheets

(51) Int. Cl.

| | |
|---|---|
| ***E04B 5/04*** | (2006.01) |
| ***E04C 2/06*** | (2006.01) |
| ***E04C 2/34*** | (2006.01) |
| ***E04B 5/48*** | (2006.01) |

(52) U.S. Cl.
CPC ..... *E04C 2/34* (2013.01); *E04C 2/521* (2013.01); *E04B 2103/02* (2013.01)

(56) References Cited

U.S. PATENT DOCUMENTS

| | | | | | |
|---|---|---|---|---|---|
| 2,230,153 | A * | 1/1941 | Allbright | E04B 1/86 52/319 |
| 2,484,695 | A * | 10/1949 | Dickey | E04B 5/40 52/336 |
| 3,973,366 | A * | 8/1976 | Balane | E04B 5/48 174/487 |
| 5,317,846 | A | 6/1994 | Michlovic | |
| 8,919,057 | B1 | 12/2014 | Dupray | |
| 11,168,476 | B1 * | 11/2021 | Tadros | E04B 5/043 |
| 2003/0097806 | A1 | 5/2003 | Brown | |
| 2009/0064617 | A1 | 3/2009 | Montoya et al. | |
| 2017/0058517 | A1 | 3/2017 | Mohle et al. | |
| 2017/0218614 | A1 | 8/2017 | Ciuperca | |

FOREIGN PATENT DOCUMENTS

| | | | | | |
|---|---|---|---|---|---|
| GB | 2350847 | A | * | 12/2000 | E04C 2/049 |
| KR | 2008056986 | A | * | 6/2008 | |
| KR | 20100061074 | A | * | 6/2010 | |
| KR | 101304335 | B1 | * | 9/2013 | |
| KR | 20140013830 | A | * | 2/2014 | |

* cited by examiner

100

400

102

CONCRETE VOIDED FLOOR PANEL

CROSS-REFERENCE TO RELATED APPLICATIONS

The present application claims the benefit under 35 U.S.C. Section 119(e) of U.S. Provisional Application No. 63/075,624, filed Sep. 8, 2020, titled ULTRA HIGH PERFORMANCE CONCRETE AND FIRE-RESISTANT CONCRETE VOIDED SLAB PANEL, naming Maher K. Tadros, Micheal Asaad, Kevin Kirkley, and Bryant Zavitz as inventors, which is incorporated herein by reference in the entirety.

TECHNICAL FIELD

The present invention generally relates to the field of composite material panels and, more particularly, to precast concrete voided floor panels.

BACKGROUND

In certain residential and commercial structures, utility systems, including but not limited to HVAC, electrical, plumbing, and fire suppression, are run above or underneath the structural floor system. Thus, the depth of these utility systems adds to the depths of the building floor-to-floor height. A structural floor system that can house utility components within its depth can allow for reduced floor-to-floor heights or allow for longer spans without increased floor-to-floor heights when compared to systems with utilities run above or underneath the structural floor. In certain structures, reductions in floor-to-floor heights can reduce the overall building height, and thus reduce the total building cost.

In certain residential and commercial structures, it can be advantageous to have a structural floor system that can accommodate a clear span of sixty feet without intermediate columns. However, slab systems that would allow for a clear span of sixty feet without intermediate columns may require a structural floor depth much greater than the depth allowed for such floor. The following example is one example of a residential or commercial structure that may take advantage of a clear span of sixty feet. Select residential and commercial structures are supported, at least in part, by parking structures positioned underneath the floors reserved for living, office, retail, and/or storage. Due to spacing constraints caused by accommodating vehicle operation and parking within the parking structure, the parking structure may be construed from slabs with clear spans of sixty feet. If the slabs above the parking area do not also span sixty feet, then the slabs above the parking structure may be supported by walls or large columns. The wall or large columns may be denser, or otherwise more closely spaced, than the load bearing walls or columns in the parking area below. The spacing of the columns may cause conflicts in the building plans for the select residential and commercial structures.

Therefore, it would be desirable to provide a pre-cast concrete apparatus, a flooring system, or a method that cures the shortcomings described above.

SUMMARY

A voided floor panel is described, in accordance with one or more embodiments of the present disclosure. In one embodiment, the voided floor panel includes a pre-cast dome. In another embodiment, the pre-cast dome includes a flange portion. In another embodiment, the pre-cast dome includes a first stem portion and a second stem portion. In another embodiment, each of the first stem portion and the second stem portion are arranged substantially orthogonal with respect to the flange portion. In another embodiment, the pre-cast dome includes a plurality of joint portions. In another embodiment, a first set of the plurality of joint portions are disposed along an end of the first stem portion. In another embodiment, a second set of the plurality of joint portions are disposed along an end of the second stem portion. In another embodiment, at least some of the first set and at least some of the second set including a plurality of rebar block-outs transversely oriented to a longitudinal span of the pre-cast dome. In another embodiment, the pre-cast dome includes a first ledge portion and a second ledge portion. In another embodiment, the first ledge portion is disposed between the flange portion and the first stem portion along the longitudinal span. In another embodiment, the second ledge portion is disposed between the flange portion and the second stem portion along the longitudinal span. In another embodiment, the voided floor panel includes a plurality of strands arranged with respect to the longitudinal span of the pre-cast dome. In another embodiment, the voided floor panel includes a plurality of reinforcing bars inserted through the plurality of rebar block-outs. In another embodiment, the voided floor panel includes a slab. In another embodiment, the plurality of joint portions, the plurality of strands, and the plurality of reinforcing bars are cast within the slab. In another embodiment, the pre-cast dome and the slab form the void along the longitudinal span.

A flooring system is described, in accordance with one or more embodiments of the present disclosure. In one embodiment, the flooring system includes a plurality of access panels. In another embodiments, the flooring system includes a plurality of the voided floor panels. In another embodiment, the plurality of voided floor panels are arranged to abut with adjacent voided floor panels. In another embodiment, the plurality of access panels are supported by the first and second ledge portions of the plurality of voided composite floors. In another embodiment, the plurality of access panels and the plurality of voided floor panels form a floor surface.

A method of forming the voided floor panels is described, in accordance with one or more embodiments of the present disclosure. In one embodiment, the method includes casting a dome in a first formwork. In another embodiment, a plurality of strands are tensioned in a second formwork. In another embodiment, the method includes lowering the dome into the second formwork, such that the plurality of strands are arranged with respect to the longitudinal span of the dome. In another embodiment, the method includes inserting a plurality of reinforcing bars through the plurality of rebar block-outs. In another embodiment, the method includes casting a slab in the second formwork. In another embodiment, the plurality of joint portions, the plurality of strands, and the plurality of reinforcing bars are cast within the slab. In another embodiment, the dome and the slab form the void along the longitudinal span.

BRIEF DESCRIPTION OF THE DRAWINGS

Implementations of the inventive concepts disclosed herein may be better understood when consideration is given to the following detailed description thereof. Such description makes reference to the included drawings, which are not necessarily to scale, and in which some features may be exaggerated and some features may be omitted or may be represented schematically in the interest of clarity. Like reference numerals in the drawings may represent and refer to the same or similar element, feature, or function. In the drawings.

DETAILED DESCRIPTION OF THE INVENTION

Figure 1A:
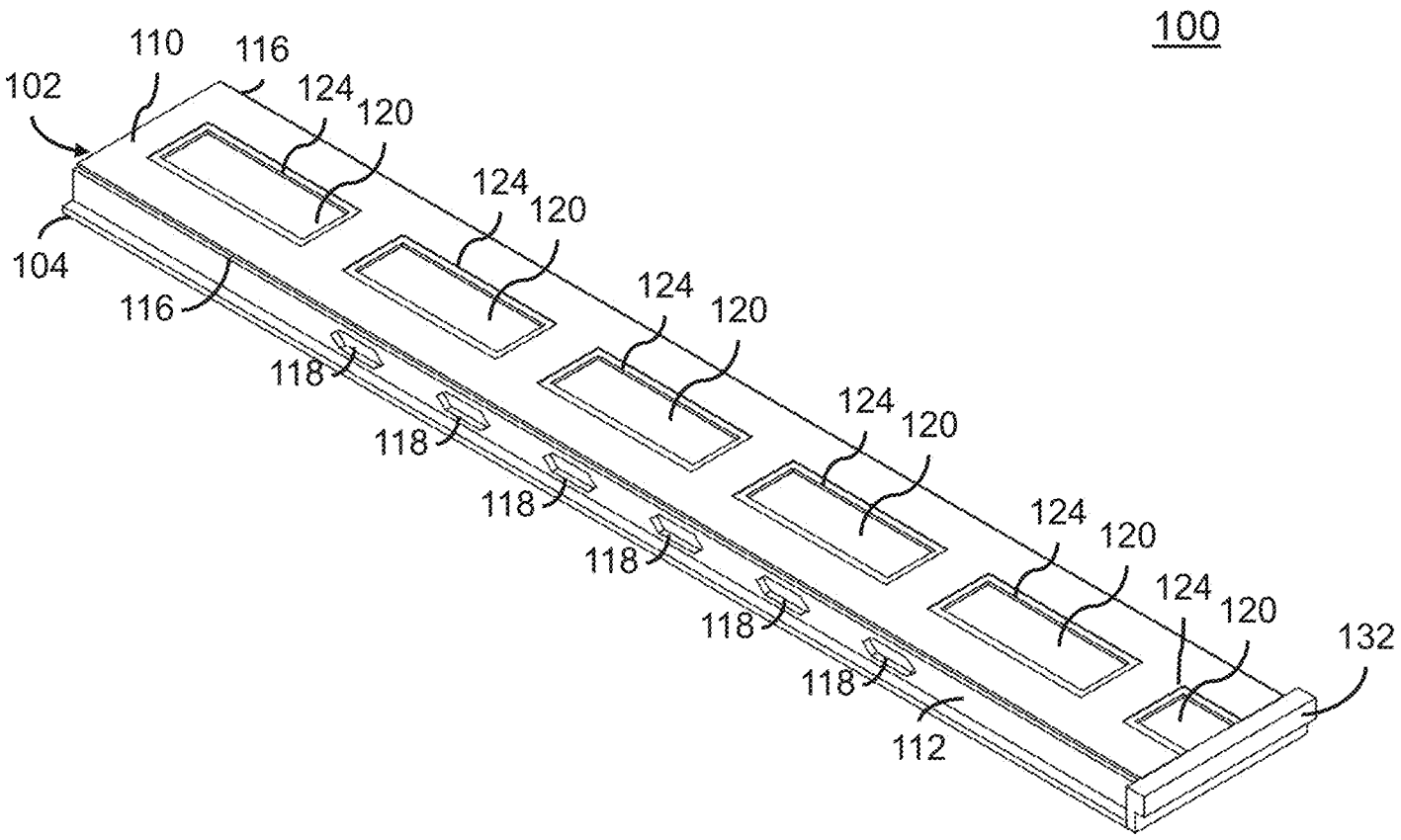
FIG. 1A depicts a perspective view of a voided floor panel, in accordance with one or more embodiments of the present disclosure.
Figure 1B:
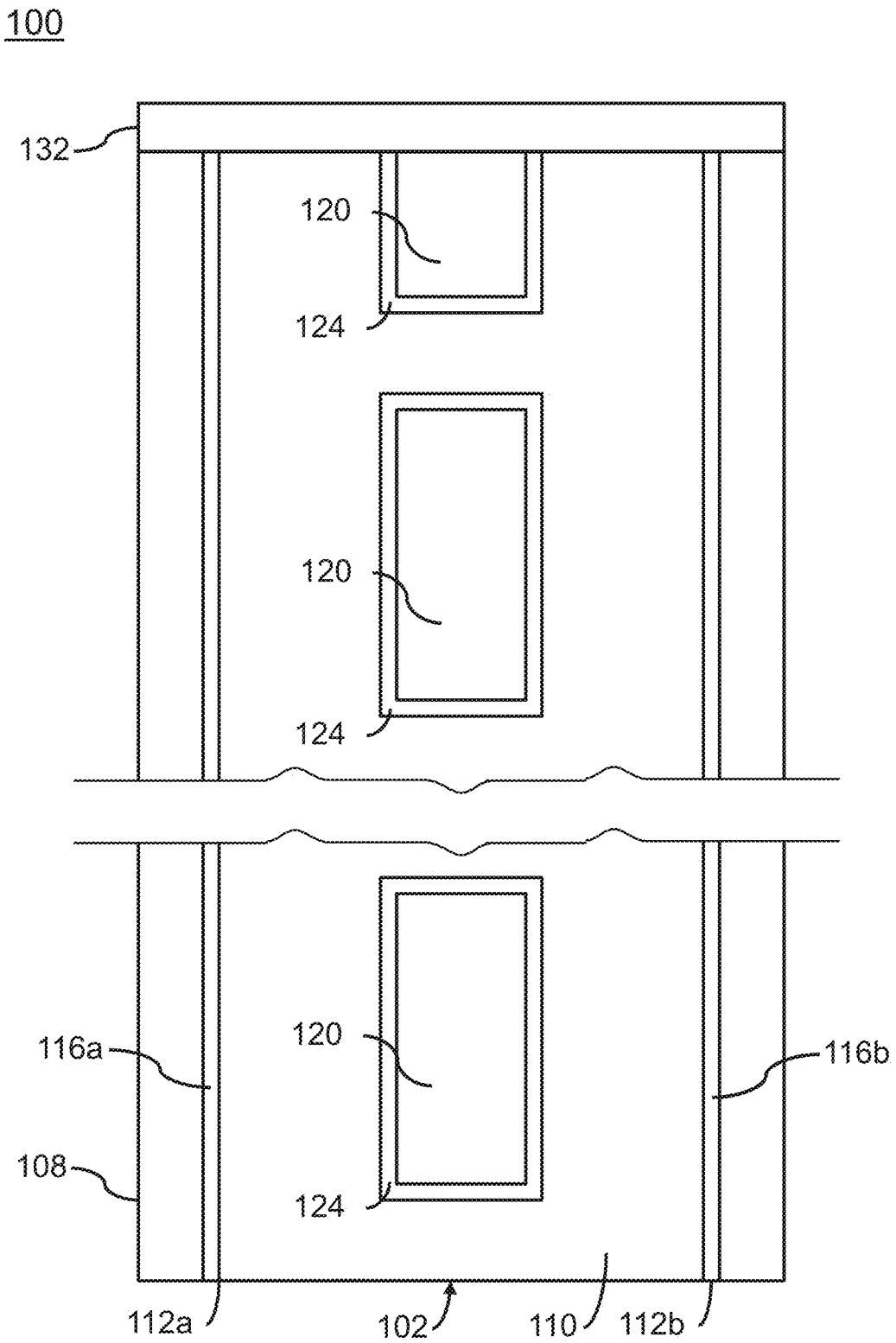
FIG. 1B depicts a partial top view of a voided floor panel, in accordance with one or more embodiments of the present disclosure.
Figure 1C:
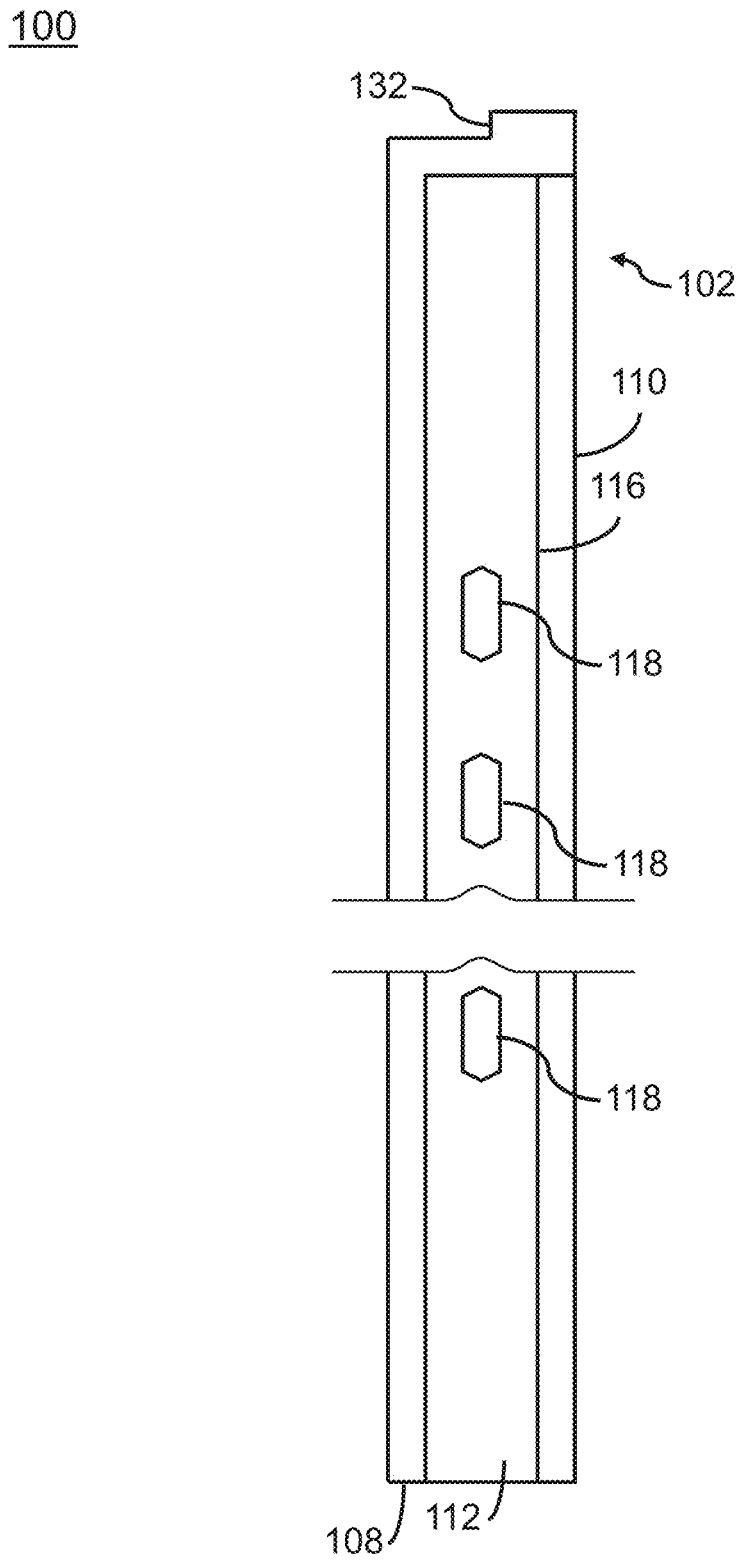
FIG. 1C depicts a partial side view of a voided floor panel, in accordance with one or more embodiments of the present disclosure.
Figure 1D:
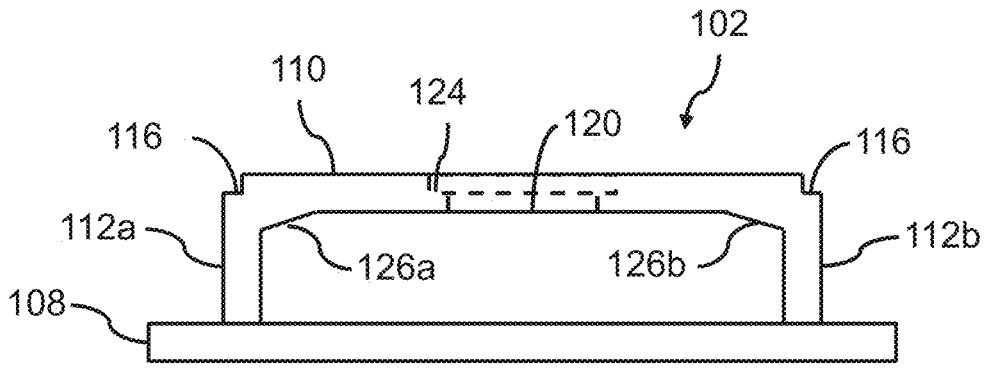
FIG. 1D depicts a front view of a voided floor panel, in accordance with one or more embodiments of the present disclosure.
Figure 1E:
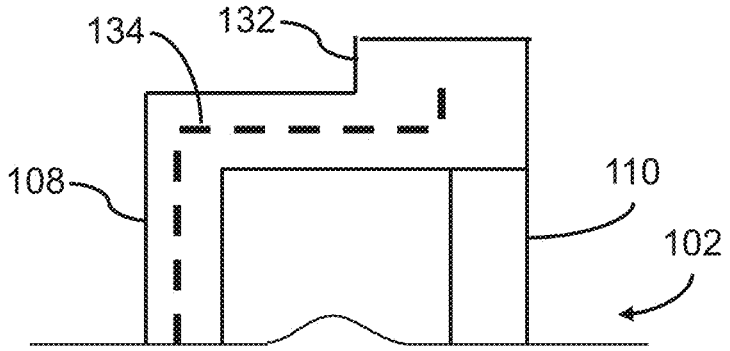
FIG. 1E depicts a partial side view of a voided floor panel, in accordance with one or more embodiments of the present disclosure.
Figure 1F:
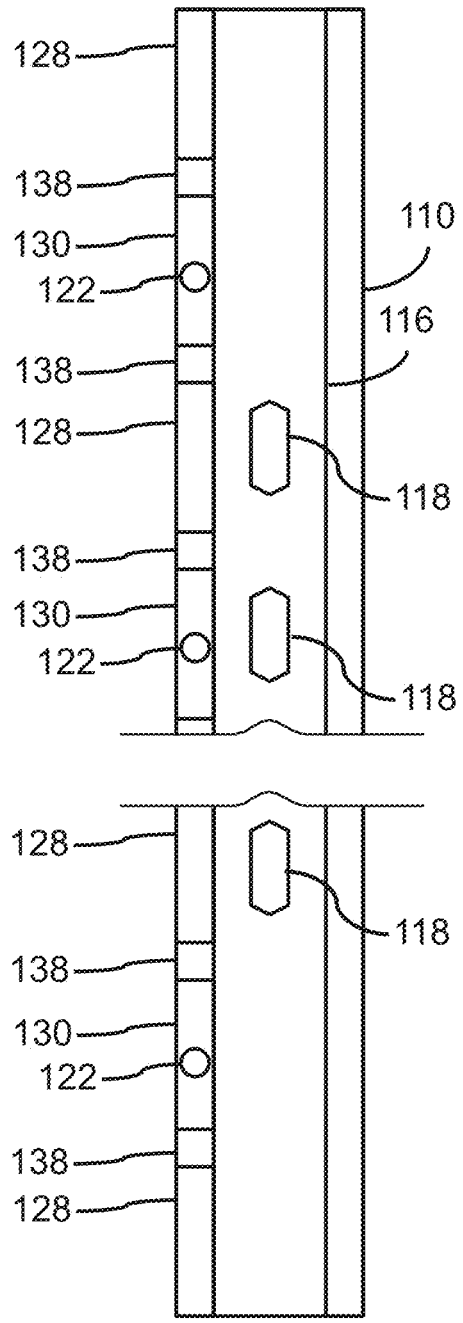
FIG. 1F depicts a partial side view of a pre-cast dome, in accordance with one or more embodiments of the present disclosure.
Figure 1G:
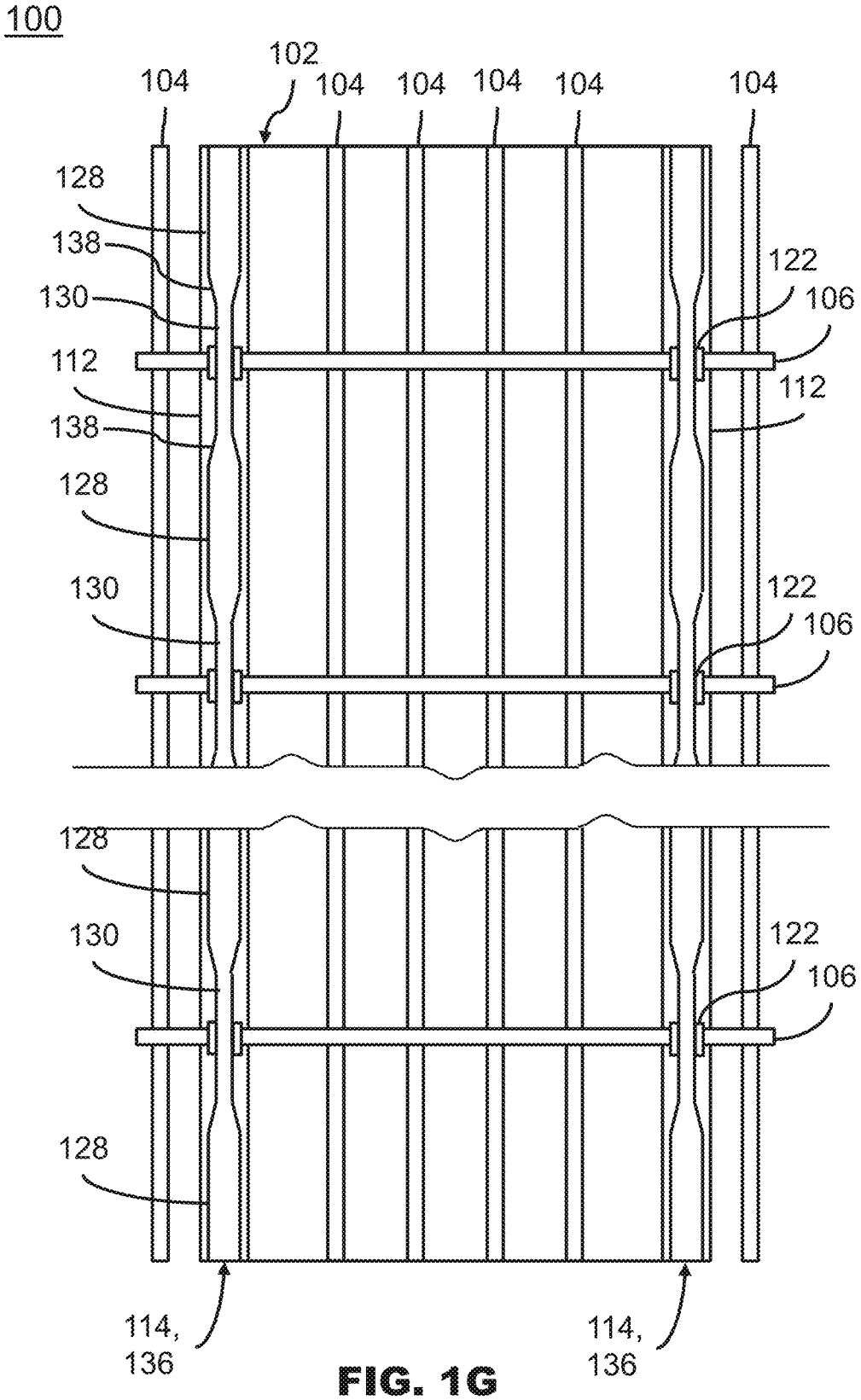
FIG. 1G depicts a partial bottom view of a voided floor panel prior to a bottom slab is cast, in accordance with one or more embodiments of the present disclosure.
Figure 1H:
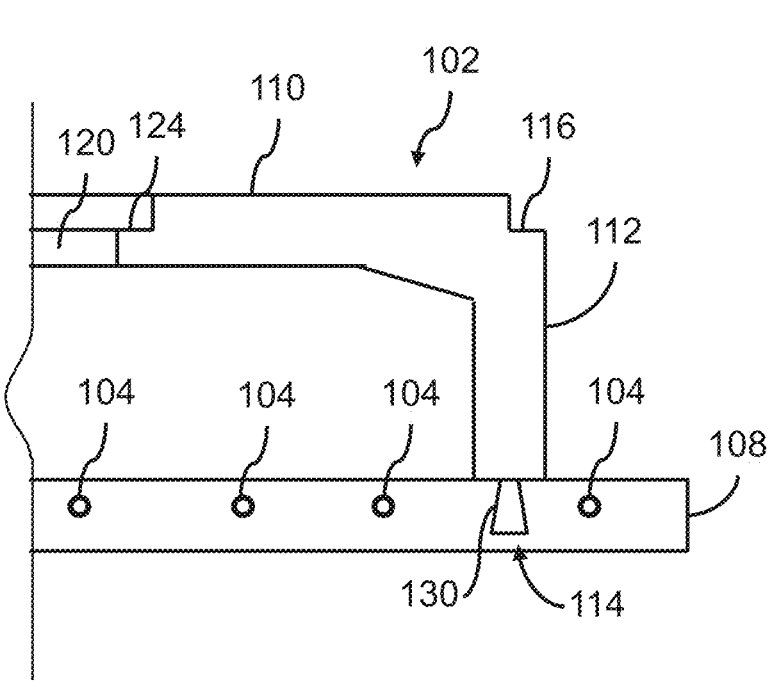
FIG. 1H depicts a cross section of a voided floor panel, in accordance with one or more embodiments of the present disclosure.
Figure 1I:
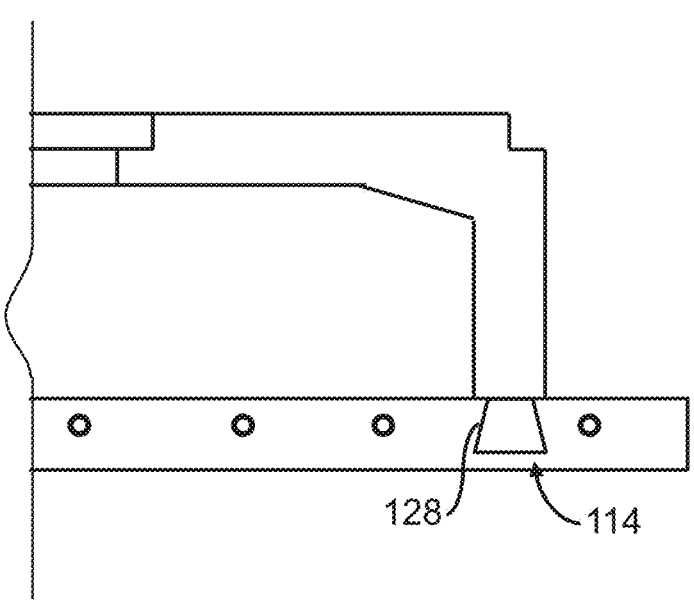
FIG. 1I depicts a cross section of a voided floor panel, in accordance with one or more embodiments of the present disclosure.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. In the following detailed description of embodiments of the instant inventive concepts, numerous specific details are set forth in order to provide a more thorough understanding of the inventive concepts. However, it will be apparent to one of ordinary skill in the art having the benefit of the instant disclosure that the inventive concepts disclosed herein may be practiced without these specific details. In other instances, well-known features may not be described in detail to avoid unnecessarily complicating the instant disclosure. The inventive concepts disclosed herein are capable of other embodiments or of being practiced or carried out in various ways. Also, it is to be understood that the phraseology and terminology employed herein is for the purpose of description and should not be regarded as limiting.

As used herein a letter following a reference numeral is intended to reference an embodiment of the feature or element that may be similar, but not necessarily identical, to a previously described element or feature bearing the same reference numeral (e.g., 1, 1*a*, 1*b*). Such shorthand notations are used for purposes of convenience only, and should not be construed to limit the inventive concepts disclosed herein in any way unless expressly stated to the contrary.

Further, unless expressly stated to the contrary, "or" refers to an inclusive or and not to an exclusive "or". For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of embodiments of the instant inventive concepts. This is done merely for convenience and to give a general sense of the inventive concepts, and "a" and "an" are intended to include one or at least one and the singular also includes the plural unless it is obvious that it is meant otherwise.

Finally, as used herein any reference to "one embodiment," or "some embodiments" means that a particular element, feature, structure, or characteristic described in connection with the embodiment is included in at least one embodiment of the inventive concepts disclosed herein. The appearances of the phrase "in some embodiments" in various places in the specification are not necessarily all referring to the same embodiment, and embodiments of the inventive concepts disclosed may include one or more of the features expressly described or inherently present herein, or any combination or sub-combination of two or more such features, along with any other features which may not necessarily be expressly described or inherently present in the instant disclosure.

Embodiments of the disclosure are generally directed to a voided floor panel, a flooring system including multiple of the voided floor panels, and to a method of manufacturing the voided floor panel. The voided floor panel may include one or more concrete components. A top component of the voided floor panel may be a pre-cast dome. The pre-cast dome may be formed from an ultra-high performance concrete (UHPC) material for providing sufficient strength while meeting or reducing a required thickness and/or for not requiring prestressing strands. A bottom component of the voided floor panel may be a slab, with one or more components of the voided floor panel embedded or cast within the slab. For example, a joint portion of the pre-cast dome together with reinforcing bars and strands may be embedded within the slab. Embodiments of the disclosure are also directed to the joint portion providing composite action between the pre-cast dome and the slab by a corrugated dovetail. Adequate flexural capacity of the voided floor panel is then provided by the various components, with the joint portion preventing the pre-cast dome from pulling apart from the slab. The slab may further meet a desired fire rating, such as a fire rating of two hours. In this regard, the slab may be formed from the UHPC material together with a fire-resistant additive, or may be formed from a lightweight concrete material. Alternatively, the slab may be formed from normal weight concrete and meet a one-hour fire rating. The pre-cast dome together with the slab may then form a void along a length of the voided floor panel, such that the panel may be considered a voided floor panel. The pre-cast dome may further include various block-outs for providing ease-of-access within the voided floor panel when the voided floor panel is installed within the flooring system.

Referring now to FIGS. 1A-1I, a voided floor panel 100 is described, in accordance with one or more embodiments of the present disclosure. The voided floor panel 100 may include one or more of a pre-cast dome 102, strands 104, reinforcing bars 106, and a slab 108. One or more portions of the pre-cast dome 102 together with the strands 104 and the reinforcing bars 106 may be embedded within the slab 108 during the casting of the slab 108.

The pre-cast dome 102 may be formed in a casting (e.g., cast with a composite concrete material). The pre-cast dome 102 may include one or more portions formed during the casting. For example, the pre-cast dome 102 may include one or more of a flange portion 110, stem portions 112, joint portions 114, ledge portions 116, utility block-outs 118, access panel block-outs 120, rebar block-outs 122, ledge portions 124, or chamfer portions 126.

The pre-cast dome 102 may include the flange portion 110. The flange portion 110 may be include a top surface which is substantially planar, for defining a surface of a floor.

The pre-cast dome may further include the stem portions 112 (e.g., first stem portion 112*a*, second stem portion 112*b*). The stem portions 112 may be arranged substantially orthogonal with respect to the flange portion 110. For example, the stem portions 112 are depicted as being at a ninety-degree angle to the flange portion 110. However, it is further contemplated that the stem portions 112 may be at an angle slightly less than or greater than ninety degrees while remaining substantially orthogonal with respect to the flange portion 110. The stem portions 112 may include a thickness of between two and four inches, such as a thickness of two and a half inches. In some embodiments, the thickness of the stem portions 112 are tapered with a decreasing thickness relative to the flange portion 110, although this is not intended as a limitation on the present disclosure. Such taper may assist in removing the pre-cast dome from a formwork. It is noted herein that "stems" and "ribs" may be considered equivalent, for purposes of the disclosure.

The pre-cast dome 102 may further include the joint portions 114. The joint portions 114 (e.g., first joint portion 114*a*, second joint portion 114*b*) may be disposed along an end of the stem portion 112. The joint portions 114 may be cast within the slab 108, thereby reducing or preventing shearing between the pre-cast dome 102 and the slab 108 in a vertical direction. Thus, the slab 108 may resist vertical separation from the pre-cast dome 102 while under flexure and may not pull apart.

In some embodiments, the joint portions 114 include one or more dovetail joints. The dovetail joint may be similar to an isosceles trapezoid, including a first base and a second base. The first base and the second base may be substantially parallel. The second base may be longer than the first base. The first base and the second base may be connected by one or more legs. Furthermore, the first base may be formed with the end of the stem portion 112. In this regard, a width of the dovetail joints may increase away from the end of the stem portion 112. For example, the dovetail joint may include a sliding dovetail (not depicted). Furthermore, the sliding dovetail may span a substantial portion of the pre-cast dome 102. As may be understood, the term "sliding" is not intended as a limitation when describing sliding dovetails and particularly when describing a corrugated sliding dovetail. Such corrugated sliding dovetails may not slide but rather reduce or prevent both horizontal and vertical shearing between the pre-cast dome 102 and the slab 108.

In some embodiments, the dovetail joint includes a corrugated sliding dovetail 136. The corrugated sliding dovetail may include a first dovetail portions 128 and second dovetail portions 130. The first dovetail portions 128 and the second dovetail portions 130 may each include first base portions formed with the end of the stem portions 112. The first base of the first dovetail portions 128 may be larger than the first base of the second dovetail portion 130. The first dovetail portions 128 and the second dovetail portions 130 may further include a second base portion, substantially parallel with the first base portion. The second base portion of the first dovetail portion 128 may be larger than the first base of the second dovetail portion 130. Furthermore, the corrugated sliding dovetail may sequence between the first dovetail portions 128 and the second dovetail portions 130, thereby forming a corrugated pattern. The corrugated sliding dovetail may thus provide composite action between the pre-cast dome 102 and the slab 108, thereby reducing a likelihood of the separation between the pre-cast dome 102 and the slab 108 under flexure. In some embodiments, a chamfer portion 138 is provided between the first dovetail portion 128 and the second dovetail portion 130.

The pre-cast dome 102 may further include the ledge portions 116. The ledge portions 116 (e.g., ledge portion 116*a*, ledge portion 116*b*) may be disposed along the longitudinal span. The ledge portion 116 may further be disposed between the flange portion 110 and the stem portion 112. The voided floor panel 100 may support one or more floor panels by the ledge portions 116. A width of the ledge portion 116 may be selected to provide a desired strength when supporting a floor panel. Such width may be selected to provide adequate strength when supporting the floor panel, together with providing an adequately sized opening for passing human operators and/or utilities. In some embodiments, the ledge portion 116 may be offset, such as, but not limited to, one-inch, from the flange portion 110 for forming a flush surface between the pre-cast dome 102 and the access panels. The offset may be based, at least in part, on a thickness of one or more removable access panels.

The pre-cast dome 102 may further include the utility block-outs 118. The utility block-outs 118 may be transverse to the longitudinal direction. The utility block-outs 118 may be disposed within the stem portions 112. For example, the utility block-outs 118 may be formed by placing a block-out with a shape when casting the pre-cast dome 102. For example, the utility block-out may include one or more of a circular block-out, a rectangular block-out, a hexagonal block-out, or an octagonal block-out. Furthermore, such block-out shapes do not need to be "regular" (i.e., including sides with all the same length and internal angles). In this regard, the utility block-out is depicted as including an irregular octagonal shape. Irregular shaped utility block-outs may provide additional room for receiving the utilities. The utility block-outs 118 may thus be suitable for receiving various utility components (e.g., wires, pipes, ductwork, or the like) configured for water utilities, power utilities, data utilities, heating, venting, and air conditioning (HVAC) utilities, or the like to be installed (e.g., within the residential or commercial floor above a parking structure, below a floor in a server farm, to the like).

The pre-cast dome 102 may further include the access panel block-outs 120. The access panel block-outs 120 may be arranged along the flange portion 110. The access panel block-outs 120 may be formed in the flange portion 110 by placing a block-out with a shape when casting the pre-cast dome 102. The access panel block-outs 120 may include any shape, such as, but not limited to, a rectangular block-out. The access panel block-outs 120 may provide access to a longitudinal void formed by the pre-cast dome 102 and the slab 108. By the access to the longitudinal void, utilities housed in the one or more longitudinal voids may be similarly accessed.

The access panel block-outs 120 may further include a ledge portion 124 disposed around a perimeter of the access panel block-out 120. The ledge portion 124 may be configured to support a floor panel. The various dimensions of the ledge portion 124 may be similar to the ledge portion 116, for providing adequate strength when supporting a floor panel. Furthermore, a thickness of the ledge portion 124 may be based, at least in part, on the thickness of the flange portion 110.

It is noted herein that the pre-cast dome 102 is not limited to the various block-outs illustrated herein. As may be understood, the pre-cast dome 102 may include a number of utility block-outs 118 or access panel block-outs 120, while meeting various loading requirements. Therefore, the above description should not be interpreted as a limitation on the scope of the present disclosure but merely an illustration. It is further noted herein that a select distance from each end of the pre-cast dome 102 may not include any utility block-outs 118 or access panel block-outs 120, but rather may be continuous. By the continuous forming from each end, a select amount of shearing performance may be preserved. For example, where the span of the pre-cast dome 102 is sixty feet, the first and last twelve feet of the pre-cast dome 102 may not include utility block-outs 118 or access panel block-outs 120. By way of another example, where the span of the pre-cast dome 102 is forty-eight feet, the first and last eight feet of the pre-cast dome 102 may not include utility block-outs 118 or access panel block-outs 120. In general, the first and last twenty percent of the pre-cast dome 102 may not include utility block-outs 118 or access panel block-outs 120. It is noted herein, however, that the pre-cast dome 102 is not limited to the above restrictions, and may include utility block-outs 118 or access panel block-outs 120 at any point along the longitudinal span. Furthermore, the one or more openings or block outs may include any set of dimensions. For example, the set of dimensions may be dependent on the desired installation of utility components within the UHPC and fire-resistant concrete voided floor panel. For instance, HVAC ducts may require 15-inch openings or block outs.

The pre-cast dome 102 may further include the rebar block-outs 122. The rebar block-outs 122 may be included within one or more of the joint portions 114. By being disposed in the joint portions 114, the reinforcing bar 106 inserted through the rebar block-outs 122 together with the joint portion 114 may be cast within the slab 108. The rebar block-outs may be transversely oriented to a longitudinal span of the pre-cast dome 102. The rebar block-outs 122 may be arranged such that the reinforcing bars 106 are oriented substantially perpendicular to the longitudinal direction. However, it is further contemplated that the rebar block-outs 122 may be angled, such that the reinforcing bars 106 may be disposed at an angle to the longitudinal direction (e.g., in a hatched pattern). However, orienting the reinforcing bars 106 substantially perpendicular to the longitudinal direction may improve an ease-of-production and reduce a required length of the reinforcing bars 106. The rebar block-outs 122 may be formed within the joint portions 114 during casting of the pre-cast dome 102. For example, the rebar block-outs 122 may be formed by circular sleeves (e.g., plastic or steel). The rebar block-outs 122 may be arranged at a given distance from adjacent rebar block-outs 122, such as, but not limited to, a distance of two feet between adjacent rebar block-outs.

The pre-cast dome 102 may further include the chamfer portions 126 (e.g., first chamfer portion 126*a*, second chamfer portion 126*b*). The chamfer portions 126 may be disposed between the flange portion 110 and the stem portions 112. The chamfer portions 126 may reduce stress concentrations of the pre-cast dome 102. In some embodiments, a thickness of the pre-cast dome 102 may be thicker near the corner between the flange portion 110 and the stem portion 112 due to the chamfer portion 126.

Thus, the pre-cast dome 102 may include one or more portions formed during the casting of the pre-cast dome 102.

The pre-cast dome 102 may further include one or more lifting loops (not depicted). For example, the lifting loops may be cast at several points along the span of the flange portion 110. The lifting loops may provide a means for removing the pre-cast dome from a formwork during the casting of the pre-cast dome.

The voided floor panel 100 may further include the strands 104. The strands 104 (i.e., PC strands) may be arranged with respect to the longitudinal span of the pre-cast dome 102. For example, the strands 104 may be arranged with a separation distance (e.g., a separation distance of two inches or more). In some embodiments, the strands may pre-stress the slab 108. The strands pre-stress the slab by being tensioned during the casting of the slab 108. For example, the strands 104 may include a tensile strength of two-hundred and seventy thousand pounds per square inch. The strands 104 may be loaded with a portion of such capacity (e.g., seventy-five percent). The tension is released subsequent to casting of the slab 108 thereby inducing a compressive force within the slab 108. The compressive strength may then improve a strength of the slab 108 in flexure. The strands 104 may include a plurality of metal strands. For example, the strands 104 may be twisted steel cable with a half-inch diameter. A number of the strands 104 may be arranged throughout the slab 108, such as between twenty and thirty strands 104. As may be understood, the specific dimensional arrangements, load capacity, and quantity of strands 104 described is not intended to be limiting. In this regard, a variety of dimensional arrangements, load capacity, and quantity of strands may be selected to provide a desired compressive stress to the slab 108.

The voided floor panel 100 may further include reinforcing bars 106. The reinforcing bars 106 may be inserted through the rebar block-outs 122. The reinforcing bars 106 may include any reinforcing bar known in the art, such as, but not limited to a steel rebar, epoxy-coated rebar, or fiberglass rebar. The reinforcing bars 106 may further be cast within the slab 108. By being cast within the slab 108, the reinforcing bar 106 may improve a resistance of the slab 108 to cracking due to tension in the lateral direction. The reinforcing bars may further improve a vertical shear resistance between the pre-cast dome 102 and the slab 108. Where the rebar block-outs 122 are transverse to the longitudinal direction, the reinforcing bars 106 may similarly be transverse to the longitudinal direction (i.e., across the width of the voided floor panel 100).

Although not depicted, the pre-cast dome 102 may also include strands and/or reinforcing bars. However, strands or reinforcing bars may not be needed in the pre-cast dome, due to the pre-cast dome being under compression during flexure, while the slab is under tension during flexure. Rather, the pre-cast dome 102 may meet or exceed desired strength requirements by being formed of a UHPC material.

The voided floor panel 100 may further include the slab 108. One or more components of the voided floor panel 100 may be cast within the slab 108. For example, the joint portions 114, the strands 104, and the reinforcing bars 106 may be cast within the slab 108. In this regard, the strands 104 may be prestressed in a formwork (not depicted). The pre-cast dome 102 may then be lowered onto or above the formwork, such that the joint portions 114 are disposed between adjacent strands 104. The reinforcing bars 106 may then be inserted through the rebar block-outs 122. A concrete material may then be deposited within the formwork, casting the joint portions 114, the strands 104, and the reinforcing bars 106 within the slab 108. In some embodiments, the joint portions 114 are embedded a distance into the slab 108, such as, but not limited to a three-inch embed. Furthermore, the slab 108 may include a substantially uniform thickness, such as, but not limited to, a four-inch thickness. Where the slab 108 includes a four-inch thickness and is composed of a lightweight concrete material, the slab 108 may be two-hour fire rated. Thus, the slab 108 may be considered fire-resistant.

In this regard, the pre-cast dome 102 and the slab 108 are not split along a central line (or corresponding plane), but rather may be split at a line (or corresponding plane) at a top surface of the slab 108. The pre-cast dome 102 together with the slab 108 may then form a void along the longitudinal span of the voided floor panel 100. For example, the span of the voided floor panel 100 may include a central longitudinal void. The void formed longitudinally through the voided floor panel 100 may be based on the width between the stem portions 112, such as, but not limited to, approximately eight feet wide.

A width of the slab 108 may be between a range of eight feet to sixteen feet, such as a width of twelve feet. By the width, the voided floor panel 100 may be fully flat when viewed from below, unlike double-tee floor panels. In this regard, the bottom surface of the slab 108 may form a ceiling for a lower floor when the voided floor panel 100 is a component in a flooring system.

A width of the flange portion 110 between the ledge portion 116*a* and the ledge portion 116*b* may be between six feet and ten feet, such as eight feet. In this regard, the slab 108 may be wider than the flange portion 110. Furthermore, the slab 108 may stick out beyond the pre-cast dome 102, by the larger width. The slab 108 may extend beyond the stem portions 112 by a distance, such as approximately two feet. In this regard, where the voided floor panel 100 abuts with an adjacent voided floor panel by an interface between the slab 108 and a slab of the adjacent voided floor panel, a gap of approximately four feet may be formed between the ledge portion 116 and ledge portion 116 of the adjacent voided slab, for receiving flooring panels. In some embodiments, a width of the gap formed between adjacent voided slabs is substantially similar to the access panel block-outs 120. In this regard, it is noted herein that the voided floor panel 100 may further include partial longitudinal voids at each edge. Such partial longitudinal void may be defined by the portion of the slab 108 extending beyond the stem portion 112, with such partial longitudinal void being shared with adjacent voided floor panels when combined in a floor system together with floor panels.

In some embodiments, the slab 108 further includes zero, one, or two dapped ends 132. The dapped ends 132 may be formed with the slab 108 during casting. The slab 108 may be dapped at the ends of the voided floor panel 100.

By the dapped ends 132, the voided floor panel 100 may be supported by an inverted-tee beam, a hidden wall corbel, or another means. A height of the dapped ends 132 may be selected such that the bottom surface of the slab 108 is flush with the bottom surface of the inverted-tee beam. For example, the height of the dapped ends 132 may be one foot. Furthermore, a depth of the dapped ends 132 may be selected such that first and second voided floor panels 100 may be supported by the inverted-tee beam. For example, the depth of the dapped ends 132 may be six inches. To meet a desired live loading capacity (e.g., a 100 psf live loading capacity on 12 ft product width capacity), a width of the dapped ends 132 may be appropriately selected. In some embodiments, a diaphragm is provided within the dapped end 132. The diaphragm may include one or more components. For example, the diaphragm may include a concrete material spanning between the stem portions 112. The diaphragm may also include a metal plate or reinforcing bar 134 bent into a shape within the dapped ends 132 and further into the slab 108. The diaphragm may thus spread the load from the dapped end 132 over a width of the pre-cast dome 102 to the slab 108 and/or the stem portions 112 of the pre-cast dome 102.

The pre-cast dome 102 and the slab 108 may be cast from one or more concrete materials. For example, one or more of the pre-cast dome 102 or the slab 108 may be cast from an ultra-high performance concrete material. The UHPC as described and used in the disclosure may be a composition of one or more of cement, sand, silica fume, accelerator, or water together steel fibers. For example, the steel fibers may be approximately 0.2 millimeters (mm) in diameter, and may range from twelve to twenty millimeters in length. The steel fibers may be mixed so as to ensure a desired level of consistency/uniformity and/or to ensure a random orientation of the steel fibers. The steel fibers may make up a select percentage of the total volume of the UHPC as described and used in the disclosure. For example, the steel fibers may be approximately two percent to six percent by volume. It is noted herein, however, that the formula for determining the correct percentage of steel fibers with respect to total volume may be dependent on a select loading density and/or a select span capacity. Furthermore, the composition of the UHPC material may be selectively controlled according to the implementation environment of the voided floor panel 100 (e.g., alkali-silica reactivity inhibitors, shrinkage-reducing admixtures, etc.). As may be understood, various compositions may be suitable for providing adequate structural strength for the voided floor panel 100. The UHPC as described and used in the disclosure may have select strength requirements that are superior to the select requirements of conventional pre-cast concrete. For example, the compressive strength of the UHPC may be approximately 18,000 pounds per square inch (psi), versus 5,000 psi for conventional concrete. By way of another example, the tensile strength of the UHPC may be approximately 2,500 psi, versus 500 psi for conventional concrete. It is noted herein that the increased strength requirements may allow for the voided floor panels with a sixty-foot span in residential or commercial floors above a parking structure. In this regard, UHPC material may be lighter, may be of a thinner thickness, and/or may require less material quantities than the select conventional concrete material, resulting in a stronger concrete that is easier to manufacture and transport.

In some embodiments, the slab 108 includes the UHPC material together with a non-metallic fire-resistant additive. For example, the non-metallic fire-resistant additive may include a polypropylene fiber. In this regard, the air voids within the slab may be desirable for achieving a desired fire rating. However, the air voids within the slab may be reduced due to particle packing by the mix constituents of the UHPC material, in accordance with particle packing theory. To meet a desired fire rating, the non-metallic fire-resistant additive may be added.

In some embodiments, the slab 108 includes a lightweight concrete material known in the art. The lightweight concrete material may be composed of one or more of lightweight coarse aggregates (e.g., shale, clay, slate, etc.) together with normal weight fine aggregates. The lightweight concrete material may thus include a density lower than regular weight concrete. For example, the lightweight concrete material may include a density of between 90 and 115 pounds per feet cubed, while regular concrete may include a density of between 140 and 150 pounds per feet cubed. The lightweight concrete material may further have a lower tensile strength than the UHPC material. In some embodiments, the slab 108 includes the lightweight concrete material while the pre-cast dome 102 includes the UHPC material. This combination of materials may provide a desired structural strength for the voided floor panel 100 while meeting a desired fire rating and/or cost. Although the slab 108 is described as including the lightweight concrete material, this is not intended as a limitation on the present disclosure. In this regard, the slab 108 may include a variety of material while achieving a desired strength and fire rating, such as, but not limited to, the lightweight concrete material, a normal weight concrete material, or the UHPC material. However, the lightweight concrete material may be desirable in reducing the weight of the slab 108, as compared to where the slab is made of normal weight concrete material or UHPC material.

The voided floor panel 100 may measure sixty feet in length/span, by twelve feet in width, by two feet in thickness. It is noted herein, however, that the voided floor panel is not limited to the provided dimensions, but may instead include a range of dimensions. The various dimensions of the voided floor panel 100 may be selected based on a desired residential or commercial construction application, including to meet various span, width, height, or load criteria. For example, the voided floor panel 100 may include a span of forty feet, forty-eight feet, sixty feet, seventy feet, one-hundred feet, or somewhere in between. By way of another example, the voided floor panel 100 may include a width of between six feet and twenty feet, such as twelve feet. By way of another example, the voided floor panel may include a thickness between one feet and four feet, such as two feet. As may be understood, the various dimensions provided herein are not intended to be limiting. In some embodiments, the various dimensions of the voided floor panel 100 are selected to provide various desired loading capacities. In some embodiments, the voided floor panel 100 may be rated with a dead loading capacity of fifteen psf. In some embodiments, the voided floor panel 100 may be rated with a live loading capacity of one-hundred psf (pounds per square foot). In some embodiments, the voided floor panel 100 includes a flexural capacity of up to 202.7 kips (901.7 kilo-newtons). The various dimensions may further be selected for providing a desired void within the voided floor panel 100 (e.g., for utilities). The various dimensions may further be selected based on the desired span.

Figure 2:
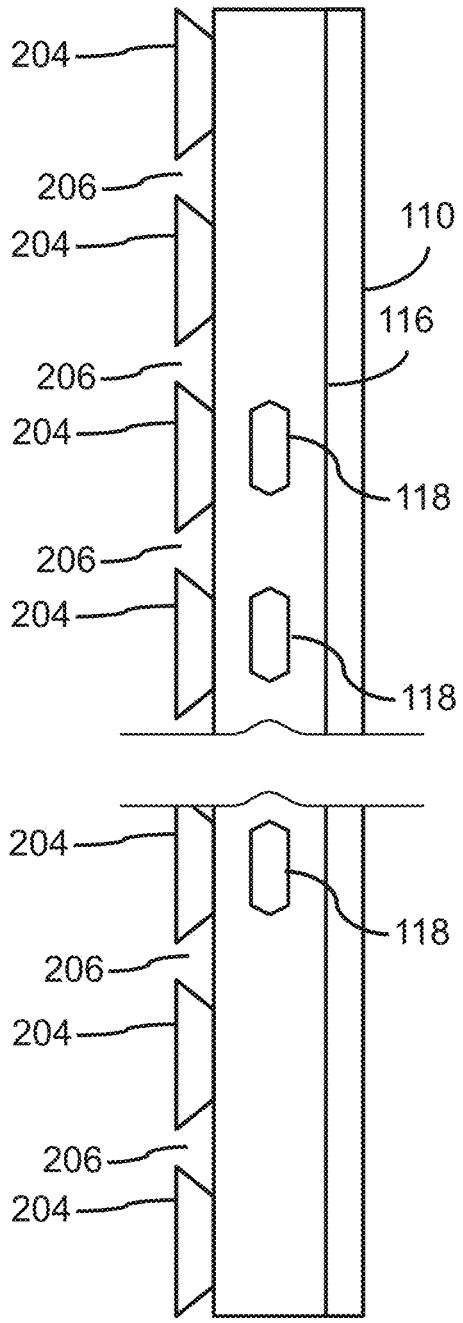
FIG. 2 depicts a partial side view of a pre-cast dome, in accordance with one or more embodiments of the present disclosure.

Referring now to FIG. 2, a pre-cast dome 202 is described, in accordance with one or more embodiments of the present disclosure. The pre-cast dome 202 may be similar to the pre-cast dome 102. Furthermore, the pre-cast dome 202 may be usable with the voided floor panel 100. The pre-cast dome 202 may similarly include joint portions 114. Although the joint portions 114 is described as a sliding dovetail or a corrugated sliding dovetail, this is not intended as a limitation on the present disclosure. For example, the joint portion 114 may include a through dovetail 204. The through dovetail 204 may be oriented such that the first base and the second base of the dovetail joint are substantially co-axial with the span of the pre-cast dome 102. Furthermore, negative portions 206 may be disposed between adjacent through dovetails, by which a portion of the slab 108 may be cast. However, such through dovetails 204 may not provide as much shearing resistance as the corrugated sliding dovetail. In some embodiments, the negative portions 206 may further receive the reinforcing bars 106, such that the negative portions 206 may be considered rebar block-outs.

Figure 3:
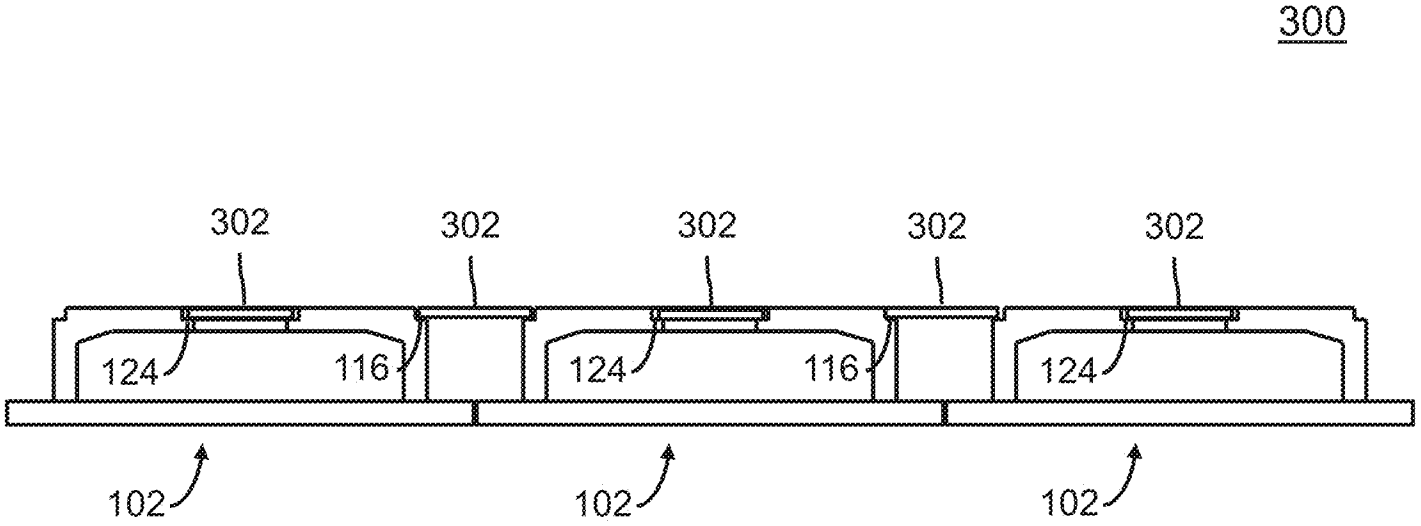
FIG. 3 depicts a front view of a flooring system including voided floor panels and access panels, in accordance with one or more embodiments of the present disclosure.

Referring now to FIG. 3, a flooring system 300 is described, in accordance with one or more embodiments of the present disclosure. The flooring system 300 may include multiple of the voided floor panels 100. The voided floor panels 100 may be adjacent to one another. Adjacent voided floor panels may be proximate to one another at the slab 108. In some embodiments, the voided floor panels 100 may abut with adjacent voided floor panels the slab 108 by a select distance. It is noted herein that the voided floor panels 100 may be spaced a selected distance apart, such as, but not limited to, ½-inch apart when installed in residential and commercial structures. The gap between the slabs 108 may then be coupled together via wet connections (e.g., utilizing cast-in-place concrete) or dry connections (e.g., utilizing welding of adjacent edges). For example, the gap may be filled in with joining material or joint material (e.g., an epoxy, plastic, cement raw material or cement mixed product such as additional fire-resistant concrete or UHPC, with a high-strength non-shrink (HSNS) grout, or the like). The voided floor panels 100 may be supported by one or more supporting members, such as, but not limited to an inverted-tee, wall corbel, or other similar means. The voided floor panels 100 may be supported by way of the dapped ends 132, such that intermediate columns may not be required.

Adjacent voided floor panels may also be separated a selected distance at the top surface of the pre-cast dome 102. Such distance may be selected based upon the amount the slab 108 extends beyond the flange portion 110 of the pre-cast dome 102. For example, such distance may include, but is not limited to four feet. The select distance may provide for receiving one or more floor panels 302. The flooring system 300 may further include one or more of the access panels 302. In this regard, the access panels 302 may be dimensioned for fitting between adjacent voided floor panels or for fitting within the access panel block-out 120 (e.g., two feet wide, four feet wide). The access panels 302 may allow workers or other individuals to access the utility components (e.g., wires, pipes, ductwork, or the like) configured for water utilities, power utilities, data utilities, heating, venting, and air conditioning (HVAC) utilities, or the like installed within the one or more voids (e.g., where the plumbing, electrical, HVAC components, or the like are installed before, during, or after installation of the voided floor panels 100). The access panels 302 may be fabricated from materials including, but not limited to, UHPC, plastic, metal, tile, or the like.

The access panels 302 may be supported by the ledge portions 116 and/or the ledge portions 124. Thus, the access panels 302 may be separately removable to access the shared opening or block-out. Furthermore, the access panels 302 may be supported by one or more vertical supports (not depicted). It is noted herein the dimensions of the access panels 302 may be at least partially determined by the desired weight of the access panels 302. Furthermore, a thickness of the access panels 302 may be such that the access panels 302 form a flush surface with the flange portion 110. For example, the thickness of the access panels 302 may be substantially similar to a height of the ledge portion 116 or the ledge portion 124.

Each opening or block-out of the voided floor panel 100 may be configured to accept one or more access panels 302. Furthermore, each opening or block-out may receive more than one access panel 302. For example, where there are multiple access panels, each of the multiple access panels may be separately removable to access the shared opening. It is contemplated that two or more access panels 302 may be disposed side-by-side between adjacent voided floor panels. It is noted herein the dimensions of the access panels may be at least partially determined by the desired weight of the access panels. For example, the access panels 302 may be 4 feet wide, and configured to fully cover the opening. By way of another example, the access panels 302 may be 2 feet wide, such that the access panels 302 are configured to partially fill the opening. In addition, vertical supports may be provided below the access panels 302 for supporting a portion of the weight of the access panel 302. For example, the vertical supports may be installed in the gap between adjacent voided floor panels, and may at least partially transfer weight from the access panel 302 onto the voided floor panels.

Select utility components (e.g., wires, pipes, ductwork, or the like) configured for water utilities, power utilities, data utilities, heating, venting, and air conditioning (HVAC) utilities, or the like may further be installed within the voided floor panels 100. The utility components may be installed within the voided floor panels before or after the installation of the voided floor panels 100 within the flooring system 300. For example, the utility block-outs 118 may receive the utility components. By way of another example, the longitudinal void between adjacent voided floor panels or the longitudinal void within the voided floor panel 100 may receive the utilities.

As may be understood, the flooring system 300 may be appreciated in a number of residential and commercial applications. For example, the flooring system 300 may be used for parking in the lower levels of a building. The flooring system 300 may provide high maneuverability of cars without fear of hitting columns. By way of another example, the flooring system 300 may be used on the upper levels of a building for residential or commercial floors. The flooring system 300 may then allow for flexibility of floor layouts without regard to placement of intermediate load bearing walls. Furthermore, the changes to utilities may be provided without disruption to the floor space above or below. By way of another example, data centers may benefit from the voided areas of the voided floor panels being easily accessible by way of an access panel for extensive wiring and cooling systems. By way of another example, the voided floor panels may be attached to the supporting columns or girders so as to maintain aesthetic appearance, with the slab being flush (e.g., at the same elevation) with the bottom of the supporting member. For instance, this may be accomplished by the dapped end of the voided floor panels. Furthermore, one or more of the utility block-outs 118 or the void formed between the flange portion 110 of the pre-cast dome 102 and the slab 108 may be suitable for receiving utilities without increasing the overall building height (i.e., as opposed to a flooring system where the utilities are run above or below the structural floor).

Figure 4:
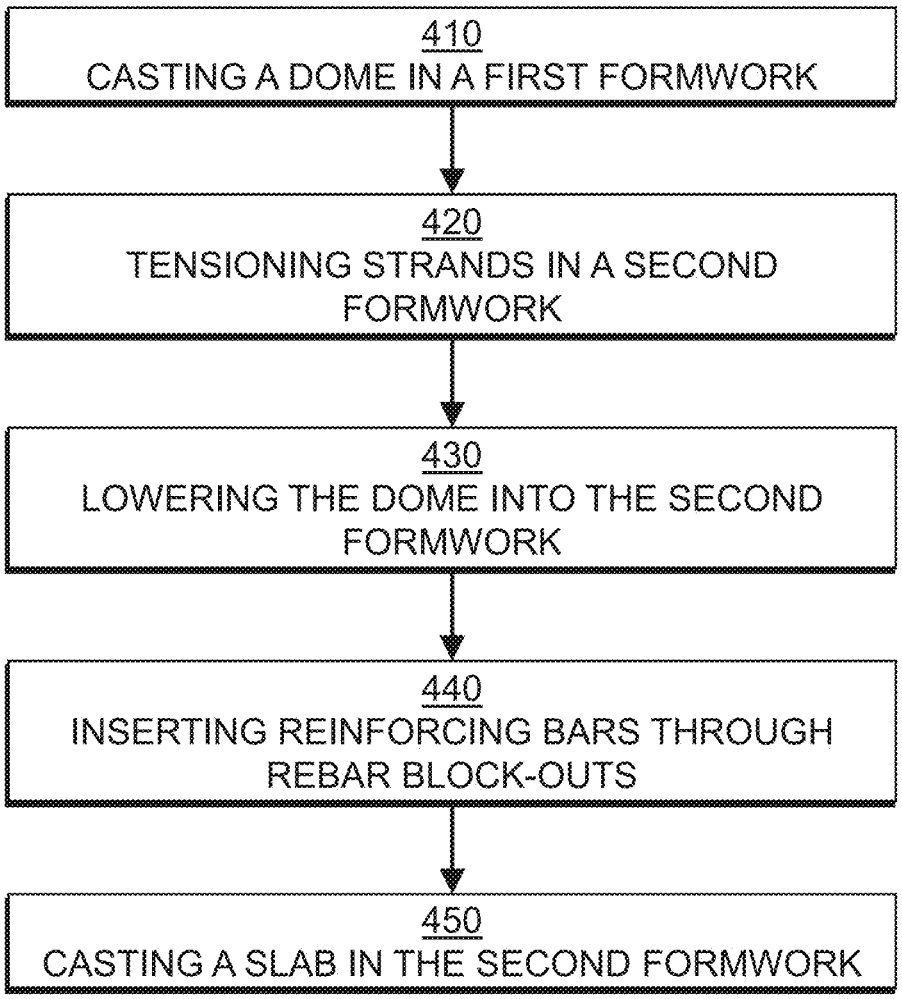
FIG. 4 depicts a flow diagram of a method of forming a voided floor panel, in accordance with one or more embodiments of the present disclosure.
Figure 5A:
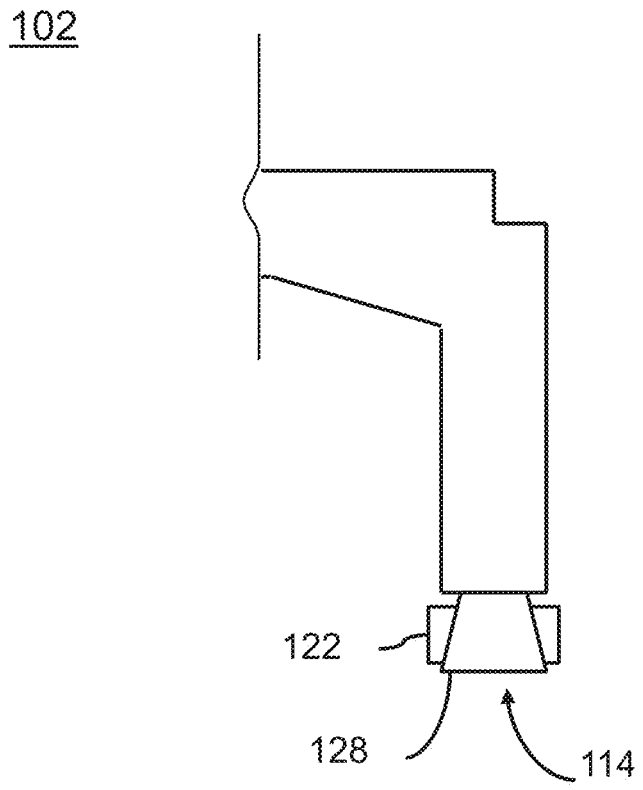
FIG. 5A depicts a partial front view of a pre-cast dome, in accordance with one or more embodiments of the present disclosure.
Figure 5B:
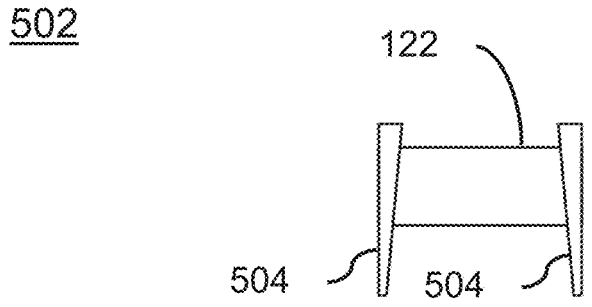
FIG. 5B depicts a dovetail form, in accordance with one or more embodiments of the present disclosure.
Figure 5C:
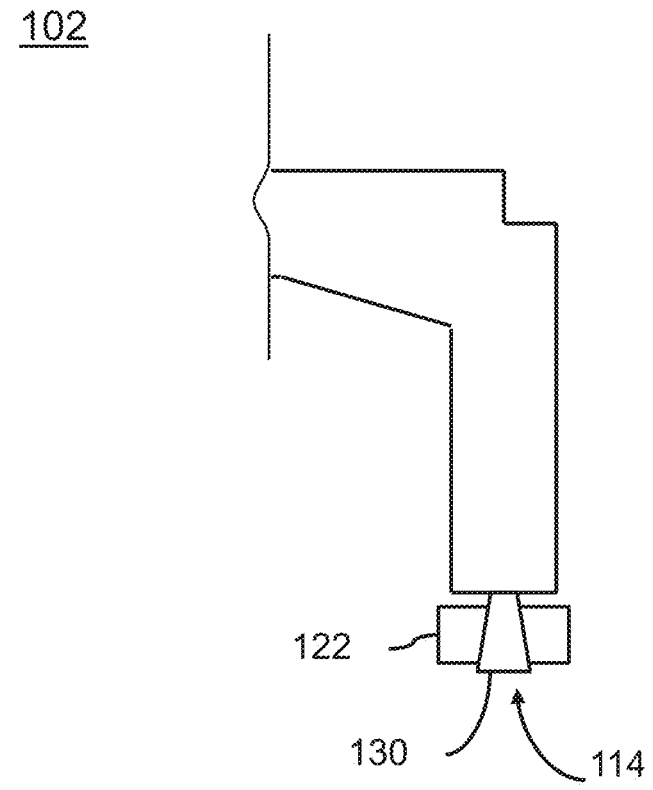
FIG. 5C depicts a partial front view of a pre-cast dome, in accordance with one or more embodiments of the present disclosure.
Figure 5D:
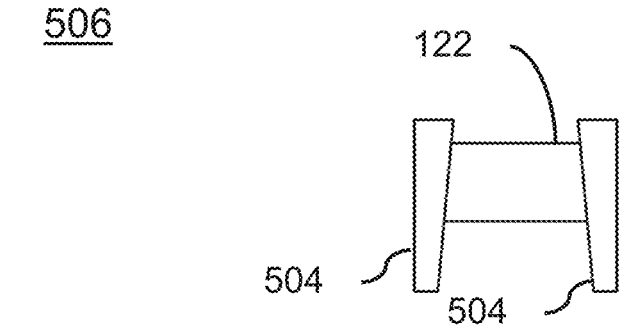
FIG. 5D depicts a dovetail form, in accordance with one or more embodiments of the present disclosure.
Figure 6A:
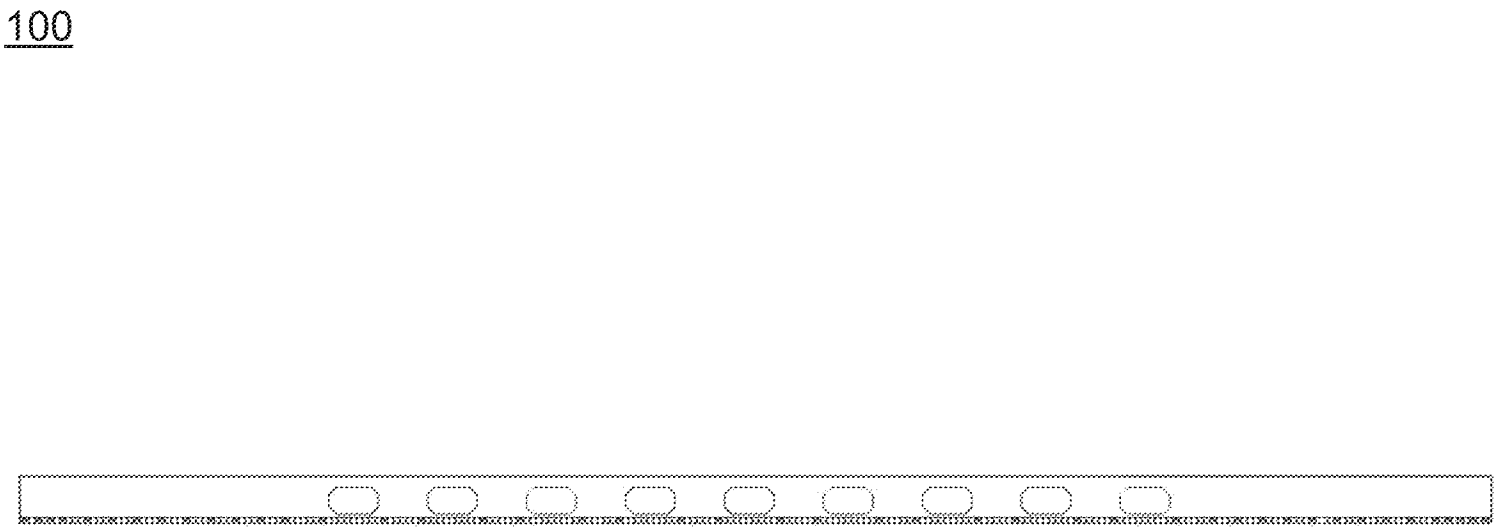
FIG. 6A depicts a side view of a pre-cast dome, in accordance with one or more embodiments of the present disclosure.
Figure 6B:
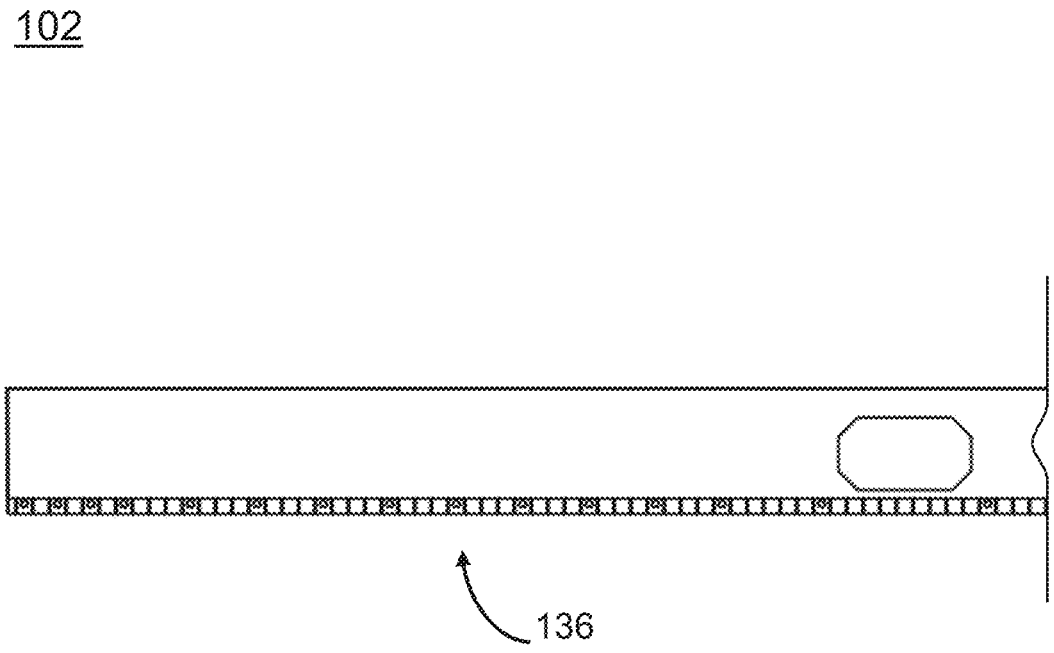
FIGS. 6B-6F depicts a partial side view of a pre-cast dome, in accordance with one or more embodiments of the present disclosure.
Figure 6C:
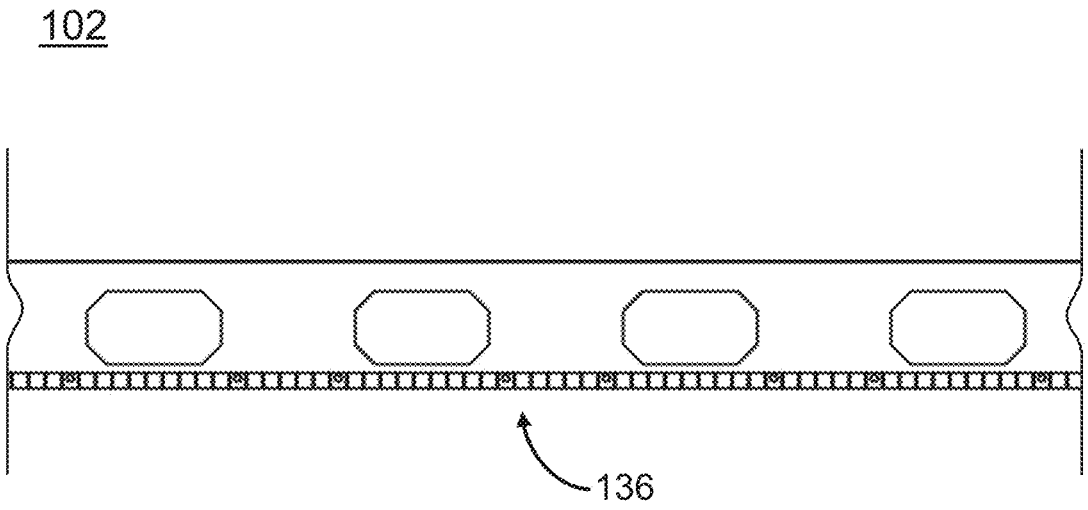
Figure 6D:
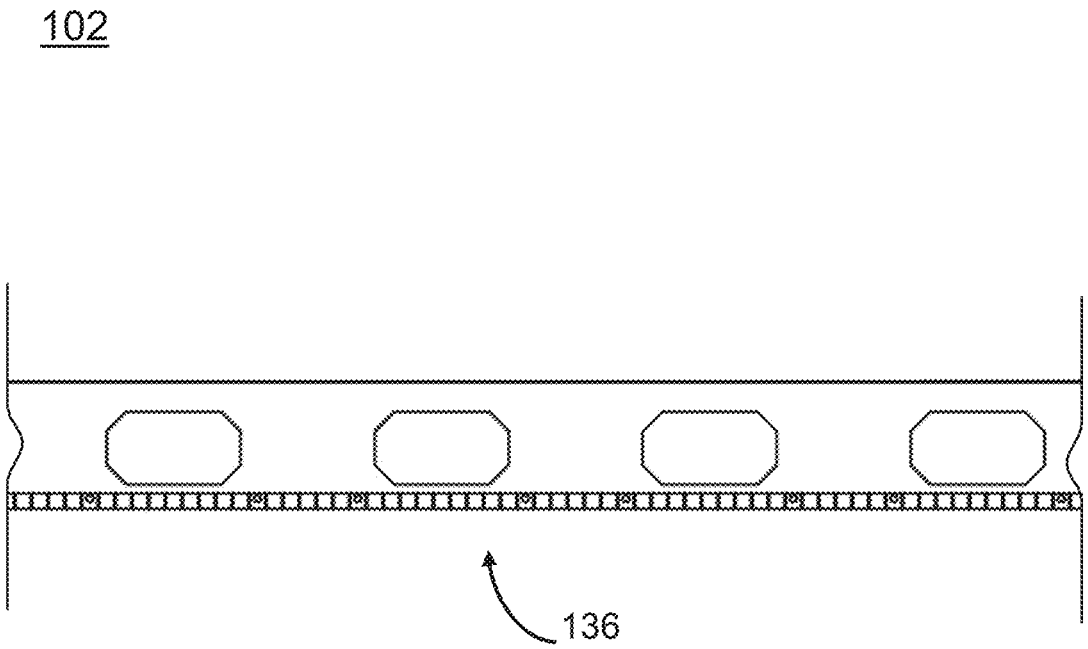
Figure 6E:
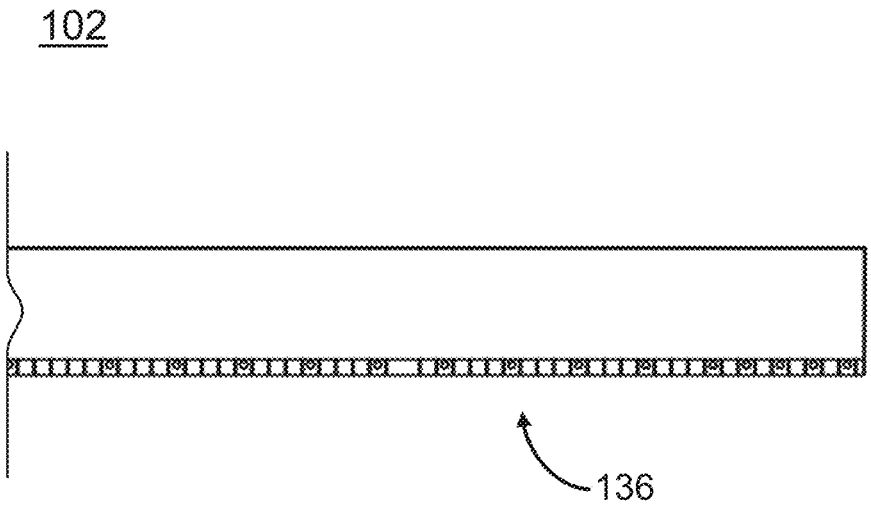
Figure 6F:
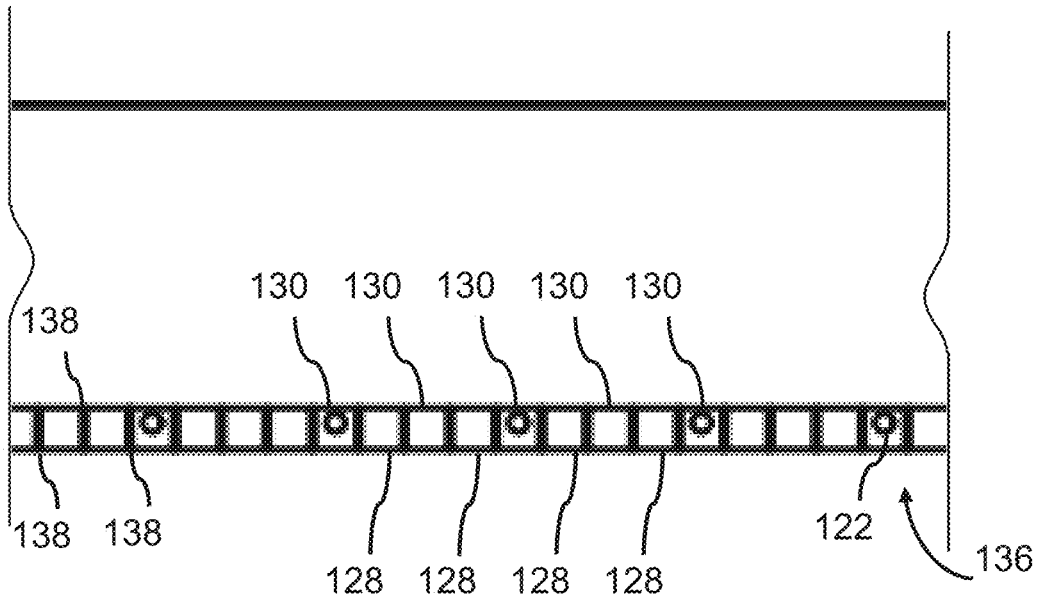
Figure 7A:
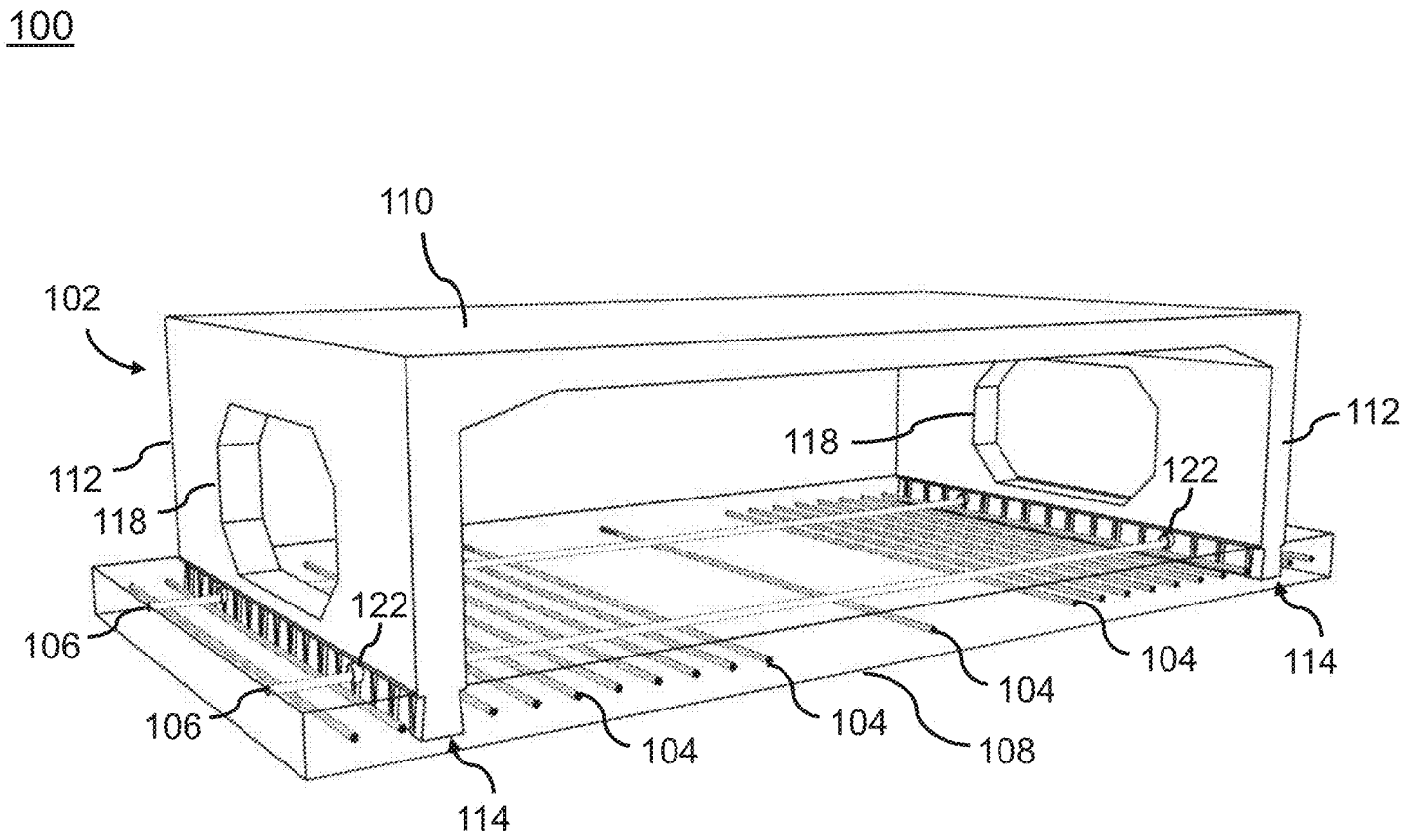
FIGS. 7A-7B depict a partial perspective view of a voided floor panel, in accordance with one or more embodiments of the present disclosure.
Figure 7B:
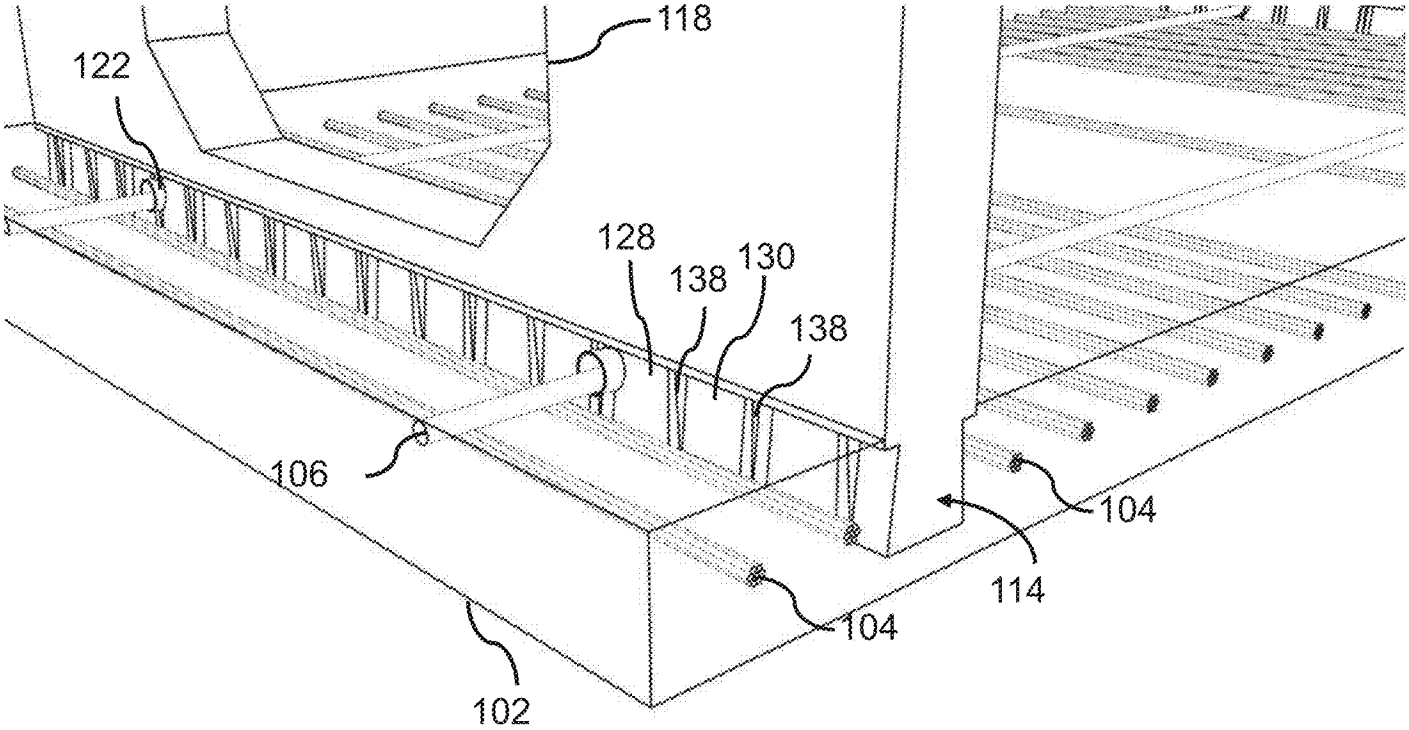
Figure 7C:
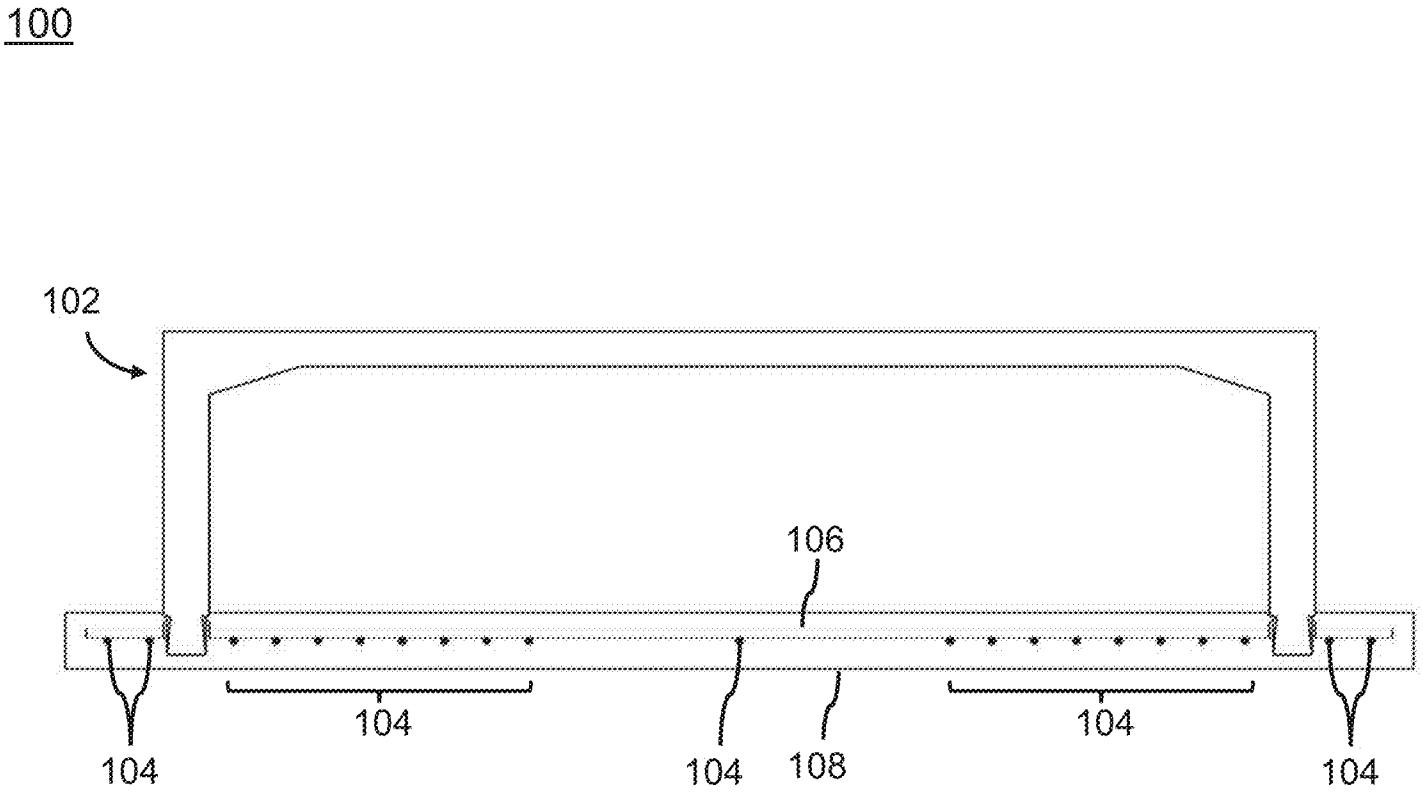
FIG. 7C depicts a front view of a voided floor panel, in accordance with one or more embodiments of the present disclosure.
Figure 7D:
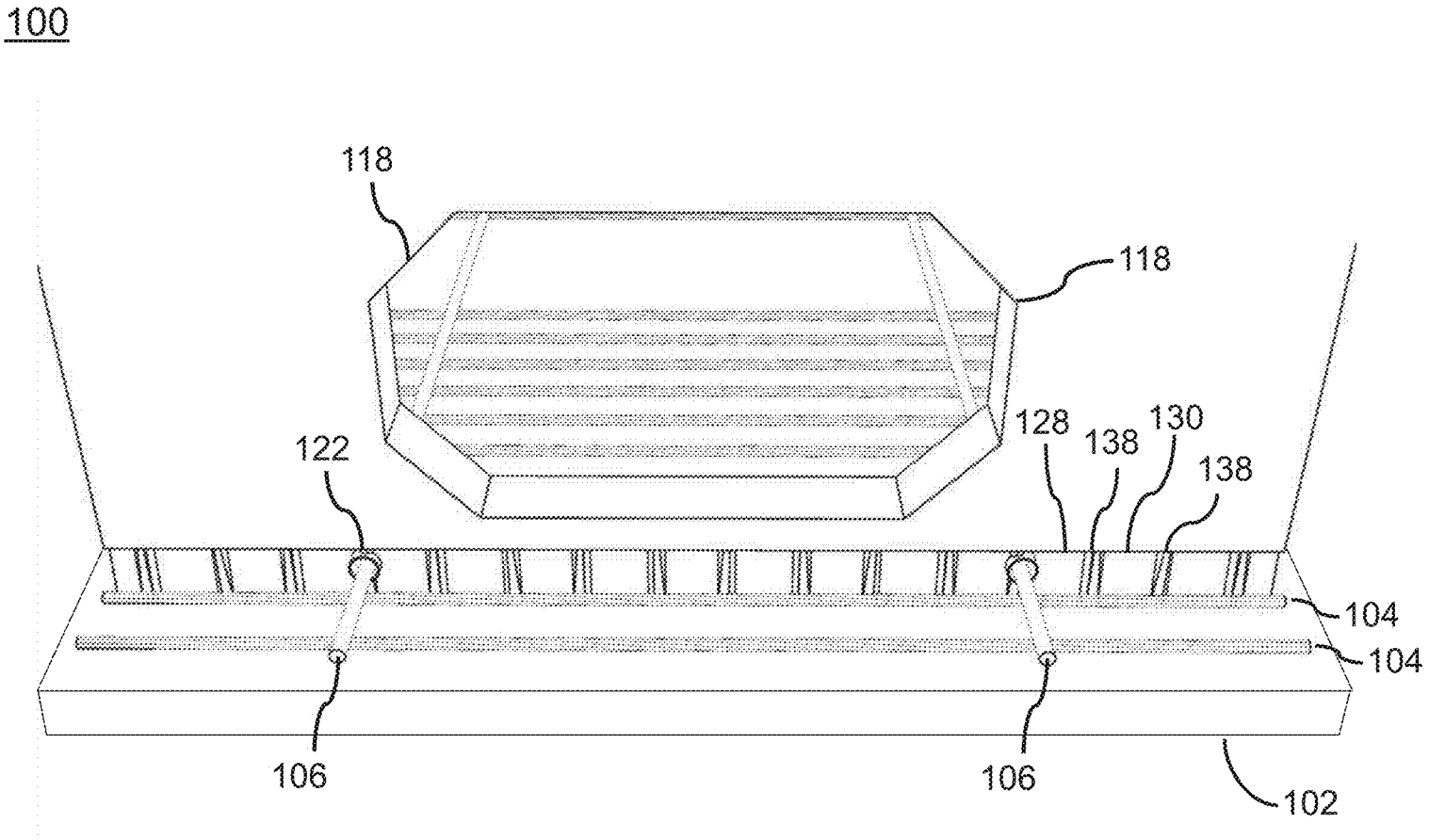
FIG. 7D depicts a partial perspective view of a voided floor panel, in accordance with one or more embodiments of the present disclosure.
Figure 7E:
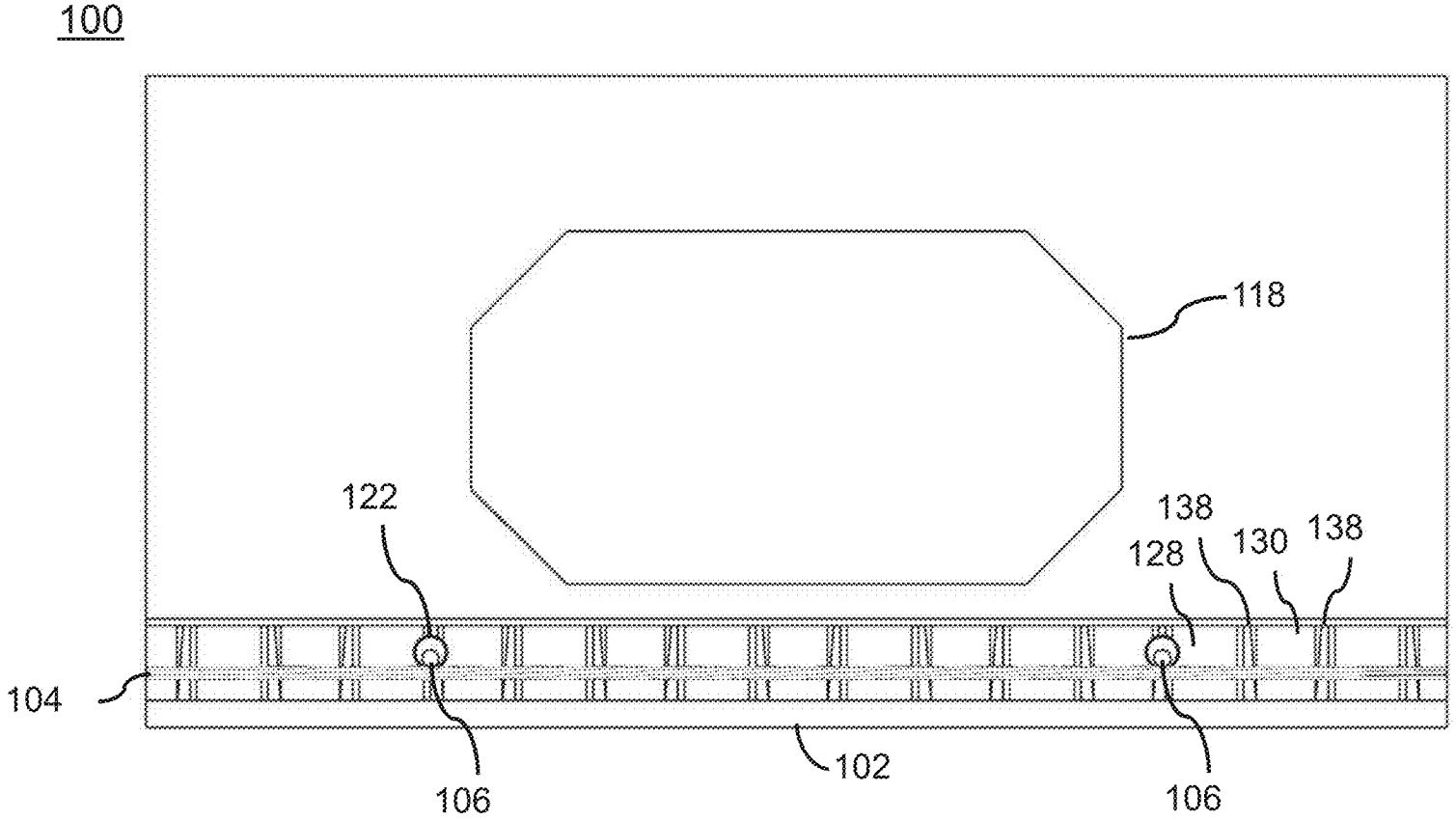
FIG. 7E depicts a partial side view of a voided floor panel, in accordance with one or more embodiments of the present disclosure.
Figure 7F:
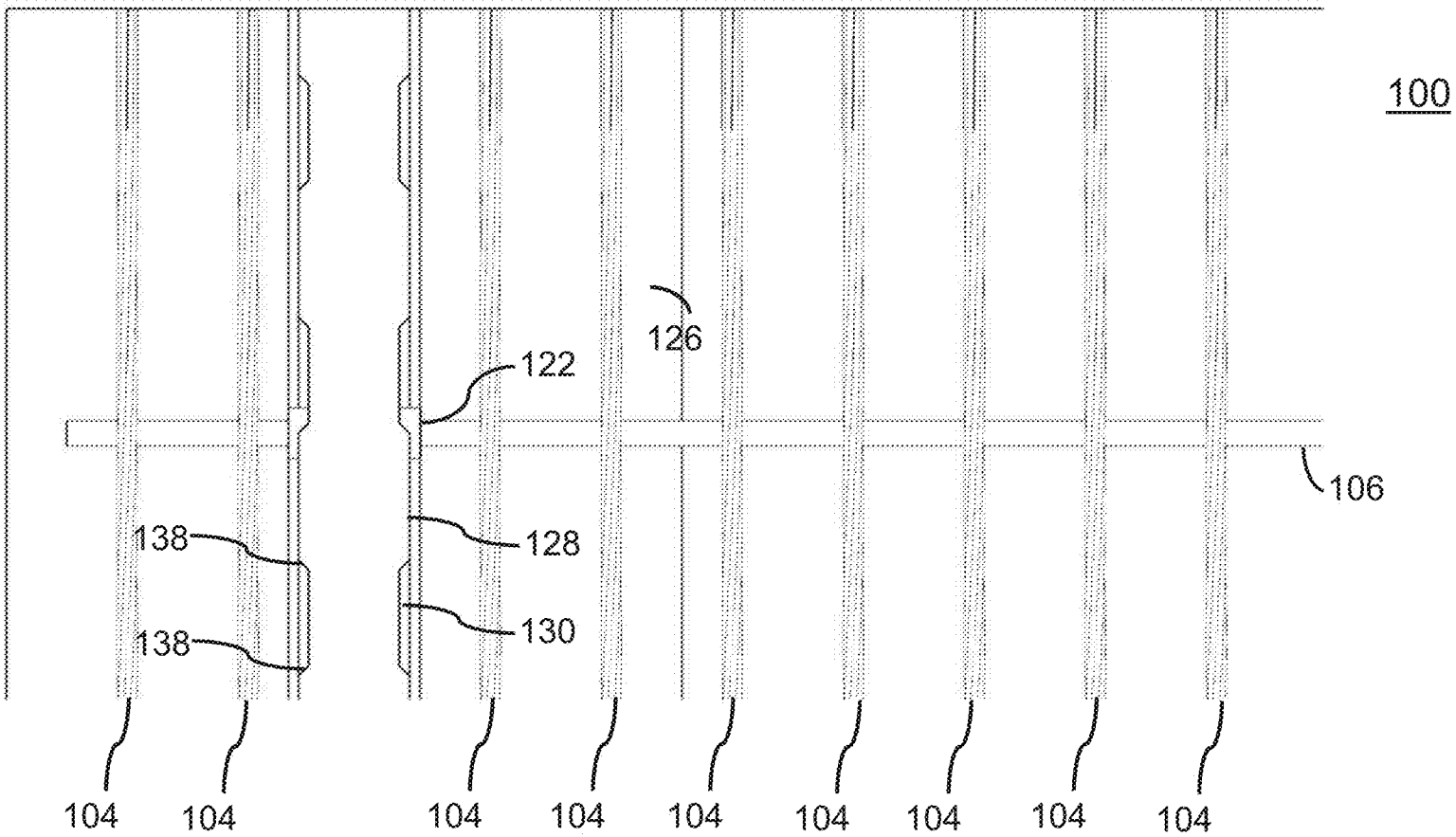
FIG. 7F depicts a partial bottom view of a voided floor panel, in accordance with one or more embodiments of the present disclosure.

Referring now to FIG. 4, a method 400 of forming a voided floor panel (e.g., voided floor panel 100) is described in accordance with one or more embodiments of the present disclosure. The embodiments and the enabling technologies described previously herein in the context of the voided floor panel 100 and the flooring system 300 should be interpreted to extend to the method 400. It is further recognized, however, that the method 400 is not limited to the voided floor panel 100 or the flooring system 300.

In a step 410, a dome (e.g., pre-cast dome 102) is cast in a first formwork. The formwork may include various block-outs or other negatives for forming one or more portions of the dome, such as, but not limited to, a flange portion, stem portions, joint portions, ledge portions, utility block-outs, access panel block-outs, rebar block-outs, or chamfer portions. The dome may be cast with the UHPC material, as previously described herein. The dome may then be allowed to set for a time, allowing the dome to cure or harden to a select hardness (e.g., not fully set state, or a fully set state). When the dome is at the select hardness, the dome may be capable of transportation or joining with a dome. For example, the dome may cure for a week or more. Thus, the dome may be considered a pre-cast dome which is cast prior to casting of the slab. As may be understood, the pre-cast dome 102 may require additional cure time before fully setting, such cure time based on the thickness of the dome. Furthermore, once the dome has been cast, the dome may be removed from the first formwork (e.g., for subsequent lowering into the second formwork). In some embodiments, the dome is cast with one or more lifting loops along the span. The lifting loops may provide a means for raising the dome from the formwork. Such lifting loops may be subsequently removed or cut from the dome at a later point. In some embodiments, the lifting loops may remain on the dome until the voided floor panel has been placed in a flooring system.

In a step 420, strands are tensioned in a second formwork. The strands may be tensioned to a desired amount, such as, but not limited to seventy-five percent of a tensile strength of the strands.

In a step 430, the dome is lowered into the second formwork. In this regard, joint portions of the dome may be lowered between adjacent strands. Furthermore, the strands may be arranged with respect to the longitudinal span of the dome. The dome may be lowered to a height such that joints of the dome are a select distance relative to the second formwork. For example, the dome may be inserted one inch away from the formwork, such that three inches of the joints may be cast within the slab.

In a step 440, reinforcing bars are inserted through the rebar block-outs of the dome. The reinforcing bars may thus be placed transverse to the strands, based on the orientation of the rebar block-outs together with the placement of the strands relative to the dome.

In a step 450, a slab is cast in the second formwork. The joint portions, the strands, and the reinforcing bars may be cast or embedded within the slab. The dome and the slab may then form the void along the longitudinal span. The slab may be cast by any suitable material, such as, but not limited to, a UPHC material with a non-metallic fire-resistant additive or a lightweight concrete material. The second formwork may further include one or more dapped end portions, such that the slab may include one or more dapped ends. As may be understood, the slab is also pre-cast prior to be shipped and installed in a flooring system.

The slab may then be allowed to harden, securing the strands, the reinforcing bars, and the joint portions. By the embedded components, a composite action may exist between the dome and the slab. The slab may be allowed to set, or at least cure to a select hardness (e.g., a not fully set state, a fully set state) that is still capable of transportation. Once the amount of curing has reached the select threshold, the strands may be cut to de-tension the slab. By such de-tensioning, a compressive force may be induced within the slab. For example, the strand de-tensioning may induce a compressive strength of at least 3,500 psi in the slab. It is noted herein a strand de-tensioning in a UHPC-manufactured slab may require a compressive strength of at least 10,000 psi in a UHPC-manufactured slab, which may take on the order of twelve hours to three days.

In some embodiments, one or more of the first formwork or the second formwork may rest on a flat steel pallet. Further, it is noted herein the formwork may include a lifting hook to re-position the formwork (e.g., on the ground or manufacturing floor). Further, it is noted herein the formwork may include a steel plate skin, supportive steel stiffeners, and/or a steel yoke. Further, it is noted herein the formwork may include sleeves or block-outs to prevent concrete from entering a defined area. In some embodiments, one or more of the dome or the slab is formed by a tunnel-form.

The method 400 described herein is not intended to be limited to the steps or sub-steps provided. The method 400 may include more or fewer steps and/or sub-steps. Furthermore, the method 400 steps and/or sub-steps may be performed simultaneously or sequentially in the order described or a different order. Therefore, the above description should not be interpreted as a limitation on the scope of the disclosure but merely an illustration. For example, the reinforcing bars may be inserted through the rebar block-outs before the dome is lowered into the second formwork. Additionally or alternatively, the slab may be poured prior to lowering the dome into the second formwork. Where the slab is poured prior to lowering the dome into the second formwork, it is contemplated that the slab should not be allowed to overly harden, such that the joint portions of the dome may not be cast within the slab.

It is noted herein that manufacturing the pre-cast dome and the slab may be beneficial in terms of manufacturing time, effort, and cost. For example, the pre-cast dome and/or the slab may not require flipping of curing or cured slabs during or subsequent to manufacture. This may reduce complications associated with the size of the voided floor panel. By way of another example, the pre-cast dome and the slab may utilize separate formworks during manufacturing. In this regard, the formwork for casting the slab may be significantly less complex than the formwork of the pre-cast dome.

Referring now to FIGS. 5A-5D, the pre-cast dome 102 is further described, in accordance with one or more embodiments of the present disclosure. In some embodiments, the pre-cast dome 102 includes the joint portion 114. The joint portion 114 may include the corrugated sliding dovetail including the first dovetail portions 128 and the second dovetail portions 130, as previously described herein. Furthermore, the pre-cast dome 102 may be cast in a first formwork. In some embodiments, the first formwork includes a first dovetail form 502 (see FIG. 5B). The first dovetail form 502 may include angled forms 504. The angled forms 504 may provide a negative surface by which the first dovetail portion 128 may be formed. As may be understood, the angle of the angled forms 504 may similarly correspond to the angle of the first dovetail portion 128. Such angled forms 504 may be made from any material suitable for forming concrete, such as, but not limited to, wood or foam. The angled forms 504 may be held in place by the first formwork until the pre-cast dome 102 is cast. The first dovetail form 502 may further include the rebar block-outs 122. In this regard, subsequent to casting of the pre-cast dome 102, the pre-cast dome 102 may be raised from the first formwork, the angled forms 504 may be removed, and the rebar block-outs 122 may remain within the pre-cast dome 102 for receiving the reinforcing bars. In some embodiments, the first formwork includes a second dovetail form 506 (see FIG. 5D). The second dovetail form 506 may be similar to the first dovetail form 502, with the exception that the second dovetail form 506 is configured to form the second dovetail portion 130. In some embodiments, the first dovetail portion 128 is thicker than the second dovetail portion 130 (e.g., thicker at the first base connecting to the stem portion, thicker at the second base disposed away from the stem portion, or thicker therebetween). The first dovetail portion 128 may be between one-quarter to one inch thicker than the second dovetail portion 130. For example, the first dovetail portion 128 may be 2.5 inches at the first base and 3 inches at the second base. By way of another example, the second dovetail portion 130 may be 2 inches at the first base and 2.5 inches at the second base. In this regard, the first dovetail portion is 0.5 inches thicker than the second dovetail portion 130 between the first base and the second base. The relative thicknesses of the first dovetail portion 128 and the second dovetail portion 130 may similarly change the angle of the chamfer portion 138 between the first dovetail portion 128 and the second dovetail portion 130.

As may be understood, the first formwork may include the first dovetail form 502 and the second dovetail form 506 in a repeating sequence (i.e., first dovetail form 502, second dovetail form 506, first dovetail form 502, second dovetail form 506, and so on) to form the corrugated sliding dovetail 136. Furthermore, one or more of the first dovetail form 502 or the second dovetail form 506 may form the chamfer portion 138 between the first dovetail joint 128 and the second dovetail joint 130. Alternatively, a separate form may be used to form the chamfer portion 138.

Referring now to FIGS. 6A-6F, the pre-cast dome 102 is further described, in accordance with one or more embodiments of the present disclosure. The first dovetail joint 128, the second dovetail joint 130, and/or the chamfer portion 138 may include a variety of dimensions for providing the desired composite action between the pre-cast dome 102 and the slab 108. The first dovetail joint 128 and the second dovetail joint 130 may each span a length of the pre-cast dome 102, such length including, but not limited to, from several inches to several feet. For example, the first dovetail joint 128 and the second dovetail joint 130 may each span around three inches. In this regard, where the pre-cast dome 102 is fifty-four feet long, the pre-cast dome 102 may include over two-hundred dovetail joints (as depicted in FIGS. 6A-6F), although this is not intended to be limiting.

Similarly, the rebar block-outs 122 may be placed in a variety of positions along the pre-cast dome 102 for providing the desired composite action between the pre-cast dome 102 and the slab 108. The rebar block-outs 122 may be placed within the joint portion 114, such as, but not limited to, the first dovetail joint 128, the second dovetail joint 130, or the chamfer portion 138. Furthermore, the rebar block-outs 122 may be placed a selected distance from adjacent rebar block-outs, such as, but not limited to, three inches, six inches, nine inches, twelve inches, fifteen inches, twenty-one inches, somewhere therein, or a greater distance. In some embodiments, the distance between rebar block-outs is based, at least in part on the length of the first joint portion 128 and the second joint portion 130. The distance between rebar block-outs may also be based on the position of the positioning of the rebar block-out 122 relative to the ends of the pre-cast dome 102. In this regard, a distance between the rebar block-outs may be relatively low (e.g., every three inches) near the ends of the pre-cast dome 102, such that additional rebar may be inserted at the ends. This may be desirable in improving a strength near the ends. Towards the center of the span of the pre-cast dome 102 fewer rebar block-outs may be placed. For example, the rebar block-outs 122 are depicted as alternating between every tenth joint portion (e.g., every 2.5 feet) followed by every sixth joint portion (e.g., every 1.5 feet), although this is not intended to be limiting.

Referring now to FIGS. 7A-7F, the voided floor panel 100 is further described, in accordance with one or more embodiments of the present disclosure. For ease of understanding, components within the slab 108 (i.e., the joint portions 114, the rebar block-outs 122, the strands 104, reinforcing bars 106) have been drawn visible through the slab 108. As may be understood, such components would not be visible through the slab material. Furthermore, although FIGS. 7A-7F do not include the ledge portion 116, this is not intended as a limitation on the present disclosure.

In some embodiments, the strands 104 are selectively arranged within the slab 108. The strands 104 may be selectively arranged to provide a desired prestressing to various portions of the slab 108. For example, the portions of the slab 108 coupling with and surrounding the joint portions 114 may experience a higher tensile force, as compared to the portion of the slab 108 nearing the middle. In this regard, a fewer amount of the strands 104 may be provided near the middle portion of the slab 108 as compared to surrounding the joint portions 114. For example, FIGS. 7A-7F depict a single strand within the middle, eight strands nearing the joint portion 114 within the void, and two strands disposed outside of the void. It is contemplated that variations of the present configuration may provide a desired amount of prestress on the slab 108.

Referring generally again to FIGS. 1A-7F.

The various block-outs described herein may be formed by a foam or other similar positive shape for making the negative void during casting. Such positive shape may then be removed subsequent to casting.

In some embodiments, the pre-cast dome 102 or the pre-cast dome 202 include one or more overhang portions or arms (not depicted). The overhang portions may cause the pre-cast dome to form a double-tee. The overhang portions may be formed with the pre-cast dome during casting. The overhang portions may include one or more ledge portions for receiving an access panel. In some embodiments, the overhang portions may be provided along the full span, a portion of the span, or be intermittently disposed along all or a portion of the span.

With respect to the use of substantially any plural and/or singular terms herein, those having skill in the art can translate from the plural to the singular and/or from the singular to the plural as is appropriate to the context and/or application. The various singular/plural permutations are not expressly set forth herein for sake of clarity.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," or the like). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, or the like" is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, or the like). In those instances where a convention analogous to "at least one of A, B, or C, or the like" is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, or the like). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

Although particular embodiments of this invention have been illustrated, it is apparent that various modifications and embodiments of the invention may be made by those skilled in the art without departing from the scope and spirit of the foregoing disclosure. Accordingly, the scope of the invention should be limited only by the claims appended hereto.

What is claimed:

1. A voided floor panel, comprising:

a pre-cast dome including:

a flange portion;

a first stem portion and a second stem portion, each of the first stem portion and the second stem portion arranged substantially orthogonal with respect to the flange portion;

a plurality of joint portions, a first set of the plurality of joint portions disposed along an end of the first stem portion, a second set of the plurality of joint portions disposed along an end of the second stem portion, at least some of the first set of the plurality of joint portions and at least some of the second set of the plurality of joint portions including a plurality of rebar block-outs transversely oriented to a longitudinal span of the pre-cast dome; and a first ledge portion and a second ledge portion, the first ledge portion disposed between the flange portion and the first stem portion along the longitudinal span, the second ledge portion disposed between the flange portion and the second stem portion along the longitudinal span;

a plurality of strands arranged with respect to the longitudinal span of the pre-cast dome;

a plurality of reinforcing bars inserted through the plurality of rebar block-outs; and a slab; wherein the plurality of joint portions, the plurality of strands, and the plurality of reinforcing bars are cast within the slab; wherein the pre-cast dome and the slab form a void along the longitudinal span.

2. The voided floor panel of claim 1, wherein the plurality of joint portions comprise dovetail joints.

3. The voided floor panel of claim 2, wherein the dovetail joints comprise corrugated sliding dovetail joints.

4. The voided floor panel of claim 1, wherein the first set of the plurality of joint portions are disposed between first adjacent strands of the plurality of strands; wherein the second set of the plurality of joint portions are disposed between second adjacent strands of the plurality of strands.

5. The voided floor panel of claim 1, wherein a width of the slab is greater than a width of the flange portion.

6. The voided floor panel of claim 5, wherein the slab extends beyond the first stem portion and the second stem portions by the width of the slab being greater than the width of the flange portion.

7. The voided floor panel of claim 1, wherein the slab includes a substantially uniform thickness.

8. The voided floor panel of claim 1, wherein the first stem portion and the second stem portion further comprise a plurality of utility block-outs transversely oriented to the longitudinal span of the pre-cast dome.

9. The voided floor panel of claim 8, where the plurality of utility block-outs include at least one of a circular block-out, a rectangular block-out, a hexagonal block-out, or an octagonal block-out.

10. The voided floor panel of claim 1, wherein the pre-cast dome further includes a plurality of access panel block-outs arranged along the flange portion.

11. The voided floor panel of claim 1, wherein the pre-cast dome further includes a chamfer portion between the flange portion and at least one of the first stem portion or the second stem portion.

12. The voided floor panel of claim 1, wherein the pre-cast dome spans between forty and one-hundred feet.

13. The voided floor panel of claim 1, wherein the plurality of strands pre-stress the slab.

14. The voided floor panel of claim 1, wherein the pre-cast dome comprises an ultra-high performance concrete material, wherein the slab comprises a lightweight concrete material.

15. The voided floor panel of claim 14, wherein a thickness of the slab is at least four inches.

16. The voided floor panel of claim 1, wherein the slab includes at least one dapped end.

17. A flooring system comprising:

a plurality of access panels; and a plurality of voided floor panels, each comprising:

a pre-cast dome including:

a flange portion;

a first stem portion and a second stem portion, each of the first stem portion and the second stem portion arranged substantially orthogonal with respect to the flange portion;

a plurality of joint portions, a first set of the plurality of joint portions disposed along an end of the first stem portion, a second set of the plurality of joint portions disposed along an end of the second stem portion, at least some of the first set of the plurality of joint portions and at least some of the second set of the plurality of joint portions including a plurality of rebar block-outs transversely oriented to a longitudinal span of the pre-cast dome; and a first ledge portion and a second ledge portion, the first ledge portion disposed between the flange portion and the first stem portion along the longitudinal span, the second ledge portion disposed between the flange portion and the second stem portion along the longitudinal span;

a plurality of strands arranged with respect to the longitudinal span of the pre-cast dome;

a plurality of reinforcing bars inserted through the plurality of rebar block-outs; and a slab; wherein the plurality of joint portions, the plurality of strands, and the plurality of reinforcing bars are cast within the slab; wherein the pre-cast dome and the slab form a void along the longitudinal span;

wherein the plurality of voided floor panels are arranged to abut with adjacent voided floor panels of the plurality of voided floor panels; wherein the plurality of access panels are supported by the first ledge portion and the second ledge portions; wherein the plurality of access panels and the plurality of voided floor panels form a floor surface.

18. The flooring system of claim 17, wherein for each of the plurality of a voided floor panels a width of the slab is greater than a width of the flange portion, wherein the plurality of voided floor panels are arranged to abut with adjacent voided floor panel of the plurality of voided floor panels by the slab abutting with an adjacent slab.

19. The flooring system of claim 17, further comprising a plurality of utilities; wherein the first stem portion and the second stem portion further comprise a plurality of utility block-outs transversely oriented to the longitudinal direction of the flange portion, wherein the plurality of utilities are inserted through the plurality of utility block-outs.

20. A method of forming a voided floor panel, comprising:

casting a dome in a first formwork, the dome including:

a flange portion;

a first stem portion and a second stem portion, each of the first stem portion and the second stem portion arranged substantially orthogonal with respect to the flange portion;

a plurality of joint portions, a first set of the plurality of joint portions disposed along an end of the first stem portion, a second set of the plurality of joint portions disposed along an end of the second stem portion, at least some of the first set of the plurality of joint portions and at least some of the second set of the plurality of joint portions including a plurality of rebar block-outs transversely oriented to a longitudinal span of the pre-cast dome; and a first ledge portion and a second ledge portion, the first ledge portion disposed between the flange portion and the first stem portion along the longitudinal span, the second ledge portion disposed between the flange portion and the second stem portion along the longitudinal span;

tensioning a plurality of strands in a second formwork;

lowering the dome into the second formwork, such that the plurality of strands are arranged with respect to the longitudinal span of the dome;

inserting a plurality of reinforcing bars through the plurality of rebar block-outs; and casting a slab in the second formwork; wherein the plurality of joint portions, the plurality of strands, and the plurality of reinforcing bars are cast within the slab;

wherein the dome and the slab form a void along the longitudinal span.

* * * * *